US009010399B2

(12) United States Patent
Perkowitz

(10) Patent No.: US 9,010,399 B2
(45) **Date of Patent: *Apr. 21, 2015**

(54) WINDOW SHADE

(75) Inventor: David Perkowitz, Vernon Hills, IL (US)

(73) Assignee: Horizons Holdings, LLC, Middleton, WI (US)

( * ) Notice: Subject to any disclaimer, the term of this patent is extended or adjusted under 35 U.S.C. 154(b) by 72 days.

This patent is subject to a terminal disclaimer.

(21) Appl. No.: 13/461,533

(22) Filed: May 1, 2012

(65) Prior Publication Data

US 2013/0292065 A1 Nov. 7, 2013

(51) Int. Cl.
*A47H 5/00* (2006.01)
*E06B 9/262* (2006.01)

(52) U.S. Cl.
CPC ..... *E06B 9/262* (2013.01); *E06B 2009/2622* (2013.01)

(58) Field of Classification Search
USPC ..... 160/291, 293.1, 298, 307, 308, 294, 160/299, 305, 84.01, 84.04
See application file for complete search history.

(56) References Cited

U.S. PATENT DOCUMENTS

| | | | | |
|---|---|---|---|---|
| 1,482,978 A | | 2/1924 | Edwards | |
| 1,951,659 A | * | 3/1934 | Kesner | 160/170 |
| 2,049,518 A | | 8/1936 | Schier | |
| 2,280,969 A | * | 4/1942 | O'Malley | 160/384 |
| 3,322,182 A | | 5/1967 | Palella | |
| 3,777,800 A | | 12/1973 | Susoev | |
| 3,999,590 A | | 12/1976 | Koch | |
| 4,623,012 A | * | 11/1986 | Rude et al. | 160/243 |
| 4,817,698 A | | 4/1989 | Rossini et al. | |
| 4,921,032 A | | 5/1990 | May | |
| 5,440,289 A | * | 8/1995 | Riordan | 340/550 |
| 5,513,687 A | | 5/1996 | Tuzmen et al. | |
| 5,566,734 A | | 10/1996 | Levy et al. | |

(Continued)

FOREIGN PATENT DOCUMENTS

WO 2010021841 2/2010

OTHER PUBLICATIONS https://www.rowleycompany.com/welcome.asp, pp. 182-187, (printed on Jul. 21, 2011, 6 pages).

(Continued)

*Primary Examiner* — Katherine Mitchell
*Assistant Examiner* — Johnnie A Shablack
(74) *Attorney, Agent, or Firm* — McCracken & Gillen LLC

(57) ABSTRACT

A window shade includes a headrail adapted for horizontal mounting above a window, a shading material attached to the headrail, and at least one cord for raising and lowering the shading material. The cord is attached to a location adjacent a lower end of the material, and extends upward through cord guides toward the headrail. The cord may be encased within a collapsible member attached to each cord guide. The collapsible member is adapted to longitudinally extend as the shading material is lowered toward a deployed position, and then longitudinally collapse as the shading material is raised toward a stowed position. The cord is secured to and is wound about a spring-loaded roller. The roller provides tension on the cord that counterbalances the weight of the shade so that the shading material may be positioned at any desired level. A stop bracket is disposed adjacent a face of the shading material and has a first portion attached to the headrail and a second portion containing a bore, wherein the cord extends from the roller through the bore and is secured to the shading material.

45 Claims, 28 Drawing Sheets

(56) References Cited

U.S. PATENT DOCUMENTS

| | | | | |
|---|---|---|---|---|
| 5,613,540 | A | 3/1997 | Jelic | |
| 5,645,685 | A | 7/1997 | Furhman | |
| 5,706,876 | A | 1/1998 | Lysyj | |
| 5,709,258 | A | 1/1998 | Coccoluto | |
| 5,722,478 | A | 3/1998 | Claypool et al. | |
| 5,743,319 | A | 4/1998 | Christopherson | |
| 5,778,957 | A | 7/1998 | Torgersen | |
| 5,797,441 | A | 8/1998 | Benthin | |
| 5,813,447 | A | 9/1998 | Lysyj | |
| 5,862,850 | A | 1/1999 | Yang | |
| 5,894,876 | A | 4/1999 | O'Brien | |
| 5,915,442 | A * | 6/1999 | Prosch | 160/84.01 |
| 6,089,303 | A | 7/2000 | Metcalf et al. | |
| 6,129,131 | A * | 10/2000 | Colson | 160/84.02 |
| 6,179,035 | B1 | 1/2001 | Anderson | |
| 6,223,802 | B1 * | 5/2001 | Colson | 160/84.02 |
| 6,257,300 | B1 | 7/2001 | Brownlie | |
| 6,463,987 | B1 | 10/2002 | Nevins | |
| 6,543,516 | B2 | 4/2003 | Hwang | |
| 6,644,374 | B2 | 11/2003 | Nien | |
| 6,662,845 | B1 | 12/2003 | Palmer | |
| 6,752,194 | B1 | 6/2004 | Huang | |
| 6,792,995 | B2 | 9/2004 | Judkins | |
| 6,823,926 | B1 | 11/2004 | Tyner | |
| 6,899,156 | B2 | 5/2005 | Tyner | |
| 6,923,236 | B2 | 8/2005 | Lin | |
| 6,938,663 | B2 | 9/2005 | Hsu | |
| 6,964,291 | B2 * | 11/2005 | Judkins | 160/170 |
| 7,147,029 | B2 * | 12/2006 | Kovach et al. | 160/121.1 |
| 7,198,087 | B2 | 4/2007 | Hsu | |
| 7,389,565 | B2 * | 6/2008 | Cheng | 16/422 |
| 7,523,777 | B2 | 4/2009 | Kim | |
| 7,624,784 | B2 | 12/2009 | Anthony et al. | |
| 7,673,665 | B2 | 3/2010 | Rossato | |
| 7,806,159 | B2 * | 10/2010 | Rossato et al. | 160/84.01 |
| 7,823,620 | B2 | 11/2010 | Kirby | |
| 7,823,953 | B2 | 11/2010 | Haas | |
| 7,823,955 | B2 | 11/2010 | Alacqua et al. | |
| 7,828,036 | B2 | 11/2010 | Tran | |
| 7,828,037 | B2 | 11/2010 | Crider | |
| 7,828,038 | B2 | 11/2010 | Livacich | |
| 7,828,039 | B2 | 11/2010 | Starzmann et al. | |
| 7,828,040 | B2 | 11/2010 | Miyachi et al. | |
| 7,828,041 | B2 | 11/2010 | Schlecht | |
| 7,830,600 | B2 | 11/2010 | Jiang | |
| 7,832,052 | B2 | 11/2010 | Vrielink | |
| 7,832,450 | B2 | 11/2010 | Brace et al. | |
| 7,832,451 | B2 | 11/2010 | Miller et al. | |
| 7,832,452 | B2 | 11/2010 | Deschenes | |
| 7,832,453 | B2 | 11/2010 | Lin | |
| 7,832,454 | B2 | 11/2010 | Lyons | |
| 7,832,455 | B1 | 11/2010 | Johnston et al. | |
| 7,833,368 | B2 | 11/2010 | Judkins | |
| 7,836,936 | B2 | 11/2010 | Graichen | |
| 7,836,937 | B2 | 11/2010 | Anderson et al. | |
| 7,841,027 | B2 | 11/2010 | Sample | |
| 7,841,376 | B2 | 11/2010 | Lin | |
| 7,841,377 | B2 | 11/2010 | Coenraets | |
| 7,841,378 | B2 | 11/2010 | Henning | |
| 7,843,640 | B2 | 11/2010 | Hooper, Jr. | |
| 7,845,383 | B2 | 12/2010 | Bowman | |
| 7,931,066 | B2 | 4/2011 | Honda et al. | |
| 8,316,911 | B2 * | 11/2012 | Cleaver | 160/84.01 |
| 8,490,668 | B2 * | 7/2013 | Snyder et al. | 160/29 |
| 2005/0092448 | A1 | 5/2005 | Lin | |
| 2005/0224188 | A1 | 10/2005 | Nien | |
| 2005/0269040 | A1 | 12/2005 | Nien | |
| 2006/0102293 | A1 | 5/2006 | Wu | |
| 2006/0278346 | A1 * | 12/2006 | Kovach et al. | 160/168.1 P |
| 2007/0000618 | A1 * | 1/2007 | Ng et al. | 160/84.01 |
| 2007/0023149 | A1 | 2/2007 | Lamars et al. | |
| 2007/0163723 | A1 * | 7/2007 | Liang | 160/84.01 |
| 2007/0277935 | A1 | 12/2007 | Lin | |
| 2007/0277936 | A1 * | 12/2007 | Sirkin | 160/84.01 |
| 2008/0173412 | A1 | 7/2008 | Rossato | |
| 2008/0223532 | A1 * | 9/2008 | Auger | 160/292 |
| 2008/0295975 | A1 | 12/2008 | Lin | |
| 2010/0126677 | A1 | 5/2010 | Lin | |
| 2010/0252209 | A1 | 10/2010 | Wang | |
| 2010/0263809 | A1 | 10/2010 | Lin | |
| 2010/0276088 | A1 | 11/2010 | Jelic et al. | |
| 2010/0276089 | A1 | 11/2010 | Jelic et al. | |
| 2010/0276090 | A1 | 11/2010 | Zagone | |
| 2010/0276091 | A1 | 11/2010 | Niswonger | |
| 2010/0280666 | A1 | 11/2010 | Marchetto | |
| 2010/0282418 | A1 | 11/2010 | Lucas | |
| 2010/0282419 | A1 | 11/2010 | Ligas, Sr. | |
| 2010/0282420 | A1 | 11/2010 | Lai | |
| 2010/0282421 | A1 | 11/2010 | Lin | |
| 2010/0288446 | A1 | 11/2010 | Foley et al. | |
| 2010/0288447 | A1 | 11/2010 | Filipiak, Jr. et al. | |
| 2010/0288448 | A1 | 11/2010 | Hormann et al. | |
| 2010/0288449 | A1 | 11/2010 | Chang et al. | |
| 2010/0288450 | A1 | 11/2010 | Bruck et al. | |
| 2010/0288451 | A1 | 11/2010 | Bohlen | |
| 2010/0288452 | A1 | 11/2010 | Coenraets | |
| 2010/0288453 | A1 | 11/2010 | Richardson | |
| 2010/0288454 | A1 | 11/2010 | Lin et al. | |
| 2010/0288455 | A1 | 11/2010 | Liscano | |
| 2010/0294437 | A1 | 11/2010 | Gonzales | |
| 2010/0294438 | A1 | 11/2010 | Kirby et al. | |
| 2010/0294439 | A1 | 11/2010 | Su | |
| 2010/0294440 | A1 | 11/2010 | Li et al. | |
| 2010/0294441 | A1 | 11/2010 | Ligas, Sr. et al. | |
| 2010/0294442 | A1 | 11/2010 | Lange | |
| 2010/0326608 | A1 * | 12/2010 | Wen et al. | 160/340 |
| 2011/0005690 | A1 | 1/2011 | Harding | |
| 2011/0005694 | A1 * | 1/2011 | Ng | 160/311 |
| 2011/0017410 | A1 | 1/2011 | Yamashita et al. | |
| 2011/0017411 | A1 | 1/2011 | Yeh | |
| 2011/0024065 | A1 | 2/2011 | Lin | |
| 2011/0036512 | A1 | 2/2011 | Su | |
| 2011/0036517 | A1 | 2/2011 | Chen | |
| 2011/0036518 | A1 | 2/2011 | Yang | |
| 2011/0048652 | A1 | 3/2011 | Chen | |
| 2011/0048653 | A1 | 3/2011 | McCarty et al. | |
| 2011/0048657 | A1 | 3/2011 | Tung et al. | |
| 2011/0056633 | A1 | 3/2011 | Lin | |
| 2011/0067819 | A1 | 3/2011 | Huang | |
| 2011/0073260 | A1 | 3/2011 | Kollman et al. | |
| 2011/0083814 | A1 * | 4/2011 | Lane | 160/84.04 |
| 2011/0083816 | A1 | 4/2011 | Chen | |
| 2011/0083818 | A1 | 4/2011 | Cross | |
| 2011/0126990 | A1 | 6/2011 | Huang | |
| 2011/0132554 | A1 | 6/2011 | Lin | |
| 2011/0132555 | A1 * | 6/2011 | Rowley et al. | 160/340 |
| 2011/0180221 | A1 | 7/2011 | Huang | |
| 2011/0209834 | A1 * | 9/2011 | Lowry et al. | 160/84.04 |
| 2012/0267056 | A1 * | 10/2012 | Ko | 160/84.04 |
| 2013/0098561 | A1 * | 4/2013 | Mullet et al. | 160/29 |

OTHER PUBLICATIONS https://www.rowleycompany.com/01_new.asp?goto=productwithrelatedproducts.aspx?session={8927FD73-C9A3-41CC-AEC9-3BC353105E5E}&peid=505&pid=2149825$pgid=11, (printed on Jul. 21, 2011, 2 pages).

U.S. Appl. No. 13/186,067, filed Jul. 19, 2011, Conf. No. 3575, Inventor David Perkowitz.

U.S. Appl. No. 13/221,471, filed Aug. 30, 2011, Conf. No. 3583, Inventor David Perkowitz.

Exhibit 1: "CIC Product : Spring Roller and Spring Roman shade with ChildSafety Breakaway system"; Uploaded by *CarrotTaiwan* on May 19, 2010; Carrot.mp4 on PC-Windows formatted Computer Disc; also available at http://www.youtube.com/watch?v=3RnUA9BZ7hU.

Exhibit 2: "Lite Touch by ITA Inc 9.21.mov", Uploaded by Haigs72001 on Sep. 22, 2010; ITA.mp4 on PC-Windows formatted Computer Disc; also available at http://www.youtube.com/watch?v=dzps4rZB0q8.

Exhibit 3: "Safe-T-Shade.wmv"; Uploaded by WindowCoveringsAssoc on May 3, 2010; Safe-t-Shade.mp4 on PC-

(56) References Cited

OTHER PUBLICATIONS

Windows formatted Computer Disc; also available at http://www.youtube.com/watch?v=owYxt8JM7EE.
Video frame #1 from Exhibit 1; "Spring Roller and Spring Roman shade with ChildSafety Breakaway system"; Uploaded by *Carrot-Taiwan* on May 19, 2010.
Video frame #2 from Exhibit 1; "Spring Roller and Spring Roman shade with ChildSafety Breakaway system"; Uploaded by *Carrot-Taiwan* on May 19, 2010.
Video frame #3 from Exhibit 2; "ITA Offers New Lite Touch™ Cordless Lift System for Roman Shades"; Uploaded by Haigs72001 on Sep. 22, 2010.
Video frame #4 from Exhibit 2; "ITA Offers New Lite Touch™ Cordless Lift System for Roman Shades"; Uploaded by Haigs72001 on Sep. 22, 2010.
Video frame #5 from Exhibit 3; "The first public look at the inner workings of Stevenson Vestal's Safe-T-Shade"; Video captured by Jenna Abbott of the Window Coverings Association of America on Friday Apr. 30, 2010.
Video frame #6 from Exhibit 3; "The first public look at the inner workings of Stevenson Vestal's Safe-T-Shade"; Video captured by Jenna Abbott of the Window Coverings Association of America on Friday Apr. 30, 2010.
United States Patent & Trademark Office Action dated Oct. 7, 2004; U.S. Appl. No. 10/697,109, filed Oct. 31, 2003; Conf. No. 8424; Inventor Henry Lin.
2nd Provisional American National Standard for Safety of Corded Window Covering Products, dated Sep. 3, 2010, ANSI/WCMA A100.1-2010 (PS2), pp. 1-46, Window Covering Manufacturing Association (WCMA), Revision of Provisional ANSI/WCMA A100.1-2009.
Selected pages from a 2010 Catalog issued by The Rowley Company, Gastonia, N.C., and believed to be available in 2010. (2 pages).

* cited by examiner

WINDOW SHADE

CROSS REFERENCE TO RELATED APPLICATION

Not applicable

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Background

The present invention generally relates to window shades, and more particularly to a lift system for use with, for example, a Roman shade.

2. Description of the Background

Various types of window coverings are known, including roller shades and Roman shades, which are also generally referred to as blinds. Roman shades typically comprise a shade suspended from a headrail. The shading material, which may be formed from a variety of materials including paper, cloth, other fabrics, and plastic and wood members, is typically moved to a stowed configuration and maintained in such configuration by a cord attached to the shade at or near its bottom edge. The shade is then deployed by letting out the cord to lower the bottom edge and, with it, the remainder of the shade. The cord is typically disposed along an outer face of the shade, and may be attached to spaced portions of the shade to promote uniform folding of the shade as the shade is being raised by the cord.

The cord of such a blind can attract the attention of a child. An infant or toddler can become entangled in a loose cord, and may be strangled by placing his/her head between the cord and the shade. Therefore, improvements in blinds have been developed to reduce the risk of such tragedies. A blind with a safety arrangement is disclosed in Lin U.S. Patent Publication No. 2005/0092448. The blind comprises a headrail, a brake mechanism proximate the headrail, a pair of cord portions that pass through the brake mechanism, and a shade cloth. The shade cloth has a lower end secured to ends of the cord portions and the cord portions extend upwardly adjacent a rear face of the shade cloth through cord covers formed of a soft material, such as yarn. A plurality of spaced positioning elements are stitched to the cord cover and to the shade cloth. Pulling ends of the cord portions adjacent a front face of the shade cloth causes the positioning elements, except the topmost positioning element, to move upwardly, thereby causing the shade cloth to wrinkle upwardly. Also, the cord covers are contracted together. Lin notes that: "a dangerous ring will not be formed by the cord and the cord covers in operation." However, Lin does not disclose the structure or configuration of the positioning elements, and therefore, does not teach in sufficient detail how such a blind may be satisfactorily constructed with materials that are aesthetically pleasing, easy to operate, and long-lasting in use. In this regard, the use of a material, such as a low-strength yarn, for the cord covers, can lead to wear and failure of the cord covers at the point(s) of attachment of uric or more of the positioning elements to the shade cloth, thereby resulting in the possibility that the a dangerous loop could be formed.

The blind disclosed in Lin also requires a user to pull ends of the cord portions in order to raise and lower the shade. This arrangement results in exposed cords accessible from the front of the shade by a child, which is undesirable.

SUMMARY OF THE INVENTION

The present invention provides a window shade capable of reducing the risk of an individual becoming entangled in a cord used to raise and lower a shade.

According to one aspect of the present invention, a window shade includes a headrail adapted for mounting adjacent a window and a rotatably mounted roller. The window shade also includes a shading material that has a first end attached to the headrail, a second end opposite the first end, and a face between the first and second ends. A cord is disposed adjacent the face and secured to the roller such that rotation of the roller causes the cord to be wound about or unwound from the roller for moving the shading material between a stowed position in which the shading material is collected adjacent the headrail and a deployed position in which at least a portion of the shading material extends away from the headrail. A shroud defines an internal passage through which the cord extends such that the shroud is adapted to extend longitudinally as the shade portion is moved toward the deployed position and the shroud is adapted to collapse longitudinally as the shade portion is moved toward the stowed position. The window shade further includes a stop bracket disposed adjacent the face having a first portion attached to the headrail and second portion containing a bore, wherein the cord extends from the roller through the bore and into the shroud.

According to another aspect of the present invention, a window shade includes a headrail adapted for mounting adjacent a window and a shading material that has an upper end attached to the headrail and a lower end opposite the upper end. The window shade also includes means for raising and lowering the shading material relative to the headrail to define a stowed position in which the shading material is collapsed and collected beneath the headrail and a deployed position in which the shading material is at least partially extended away from the headrail. The window shade further includes first and second cords each of which is attached at a first end to the means for raising and lowering and extends downwardly away from the headrail and is attached at a second end to the lower end of the shading material. First and second collapsible shrouds define an internal passage that extends in a longitudinal direction and the first and second cords are disposed within a portion of the internal passages of the first and second shrouds. The window shade also includes first and second stop brackets that are disposed adjacent the shading material and each have a first portion attached to the headrail and a second portion containing a bore such that the first and second cords extend from the means for raising and lowering through the bores of the first and second stop brackets, respectively, and into the first and second collapsible shrouds.

According to a further aspect of the present invention, a window shade that has a headrail, a shade material attached to the headrail, a roller rotatably mounted to the headrail, a cord adapted to be wound about the roller, and an attachment mechanism that fastens the cord to the shade material includes an improvement. The improvement includes a stop bracket having a first end adapted for attachment to the headrail and having a second end adapted to be disposed between the roller and the shade material, wherein the second end includes a bore adapted to receive a portion of the cord between the shade material and the roller.

According to a still further aspect of the present invention, a method of assembling and using a window shade that has a headrail, a shade material attached to the headrail, a roller rotatably mounted to the headrail, a cord adapted to be wound about the roller, and an attachment mechanism that fastens the cord to the shade material, includes the step of obtaining a stop bracket having first and second ends, wherein the second end includes a bore and is adapted to be disposed between the roller and the shade material. The method also includes the steps of attaching the first end of the stop bracket to the headrail and threading the cord through the bore of the stop bracket, wherein the stop bracket prevents the shade material from gathering about the roller when the cord is pulled to raise the shade material.

A significant advantage of this invention is that each cord is encased within a collapsible shroud, and is therefore unable to become loose and hang free from the shade. According to a preferred aspect of the invention, the cord guides are spaced sufficiently close together to preclude a child from placing his or her head between the collapsible shroud and the shading material, and therefore between the cord and shading material.

Other aspects and advantages of this invention will be better appreciated from the following detailed description.

DETAILED DESCRIPTION OF THE DRAWINGS

Figure 1:
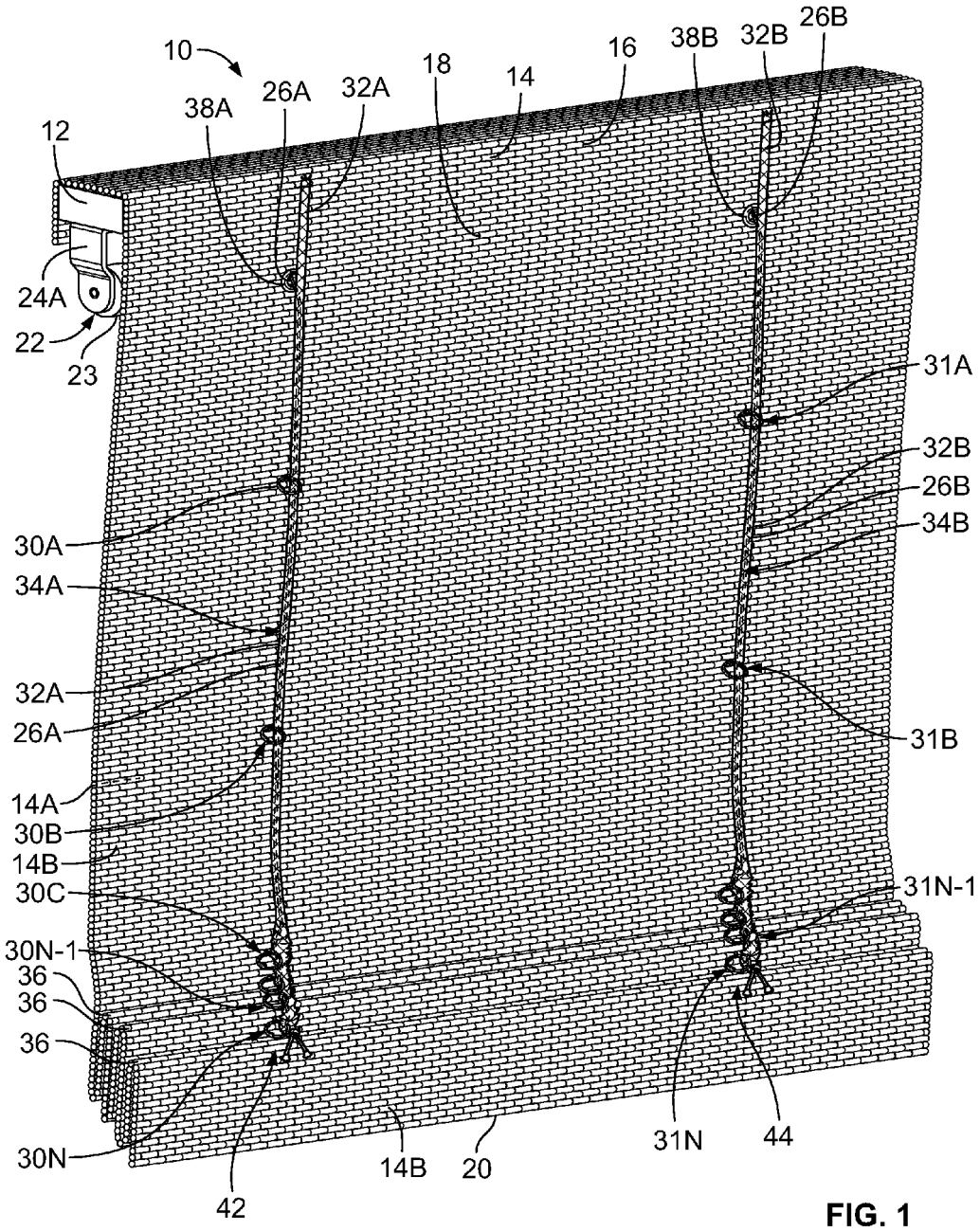
FIG. 1 comprises a rear isometric view of a window shade 10 in accordance with an embodiment of the present invention.

FIG. 1 depicts a Roman-type window shade 10, though it will become evident that the benefits of the present invention can be applied to other types of window shades. To facilitate the description of the shade 10 provided below, the terms "vertical." "horizontal," "front," "rear," "side," "upper," "lower," "above," "below," etc., may be used, in which case such terms reference the viewpoint of an operator facing a window in or on or adjacent to which the shade 10 is installed. For example, the shade 10 is preferably adapted to be mounted adjacent or above a window or within a window casing to allow a shading material 14 of the shade 10 to hang vertically downward and serve as a window treatment for the window.

In the embodiment shown in FIG. 1, the shading material is formed of a plurality of wood sections 15. The wood sections 15 generally alternate between thin flat sections 15A and circular rod sections 15B. The wood sections 15 are held together by weaving cords 17.

Alternatively, the shading material 14 may be formed of a variety of materials and provide a range of shading effects. For example, the shading material 14 may be completely opaque or have some degree of translucency. Other nonlimiting examples of suitable materials for the shading material 14 include one or more pieces of paper, one or more pieces of cloth fabrics, wooden and bamboo slats, one or more metal pieces, and plastic materials. More generally, the shading material 14 may be formed from a single piece of material or multiple individual pieces of one or more materials held together in some manner to form a flexible structure. Depending on the intended installation, either or both of front and rear faces or surfaces 14A and 14B, respectively, of the shading material 14 can be decorative.

The shading material 14 has a first or upper end 16 attached to a headrail 12, wherein the latter is adapted to be horizontally mounted adjacent and/or above a window with any suitable type of hardware (not shown). As a result, the shading material 14 is suspended to hang downwardly from the headrail 12 so that a portion 18 of the material 14 is able to serve as a shade in front of the window. A second or lower end of the shading material 14 relative to the headrail 12 defines a lower edge 20 of the shade portion 18. The shading material 14 is movable between a stowed position in which the material 14 is collapsed and collected (preferably folded) beneath the headrail 12. For example, the entire shade portion 18 can be further raised from the position shown in FIG. 1 so that the remainder of the shade portion 18 between the headrail 12 and the folds 36 also becomes folded. By further lowering the shade portion 18 from the position shown in FIG. 1, the shading material 14 is movable to a partially or fully deployed position in which the material 14 is preferably capable of substantially or completely covering the window.

Figure 3:
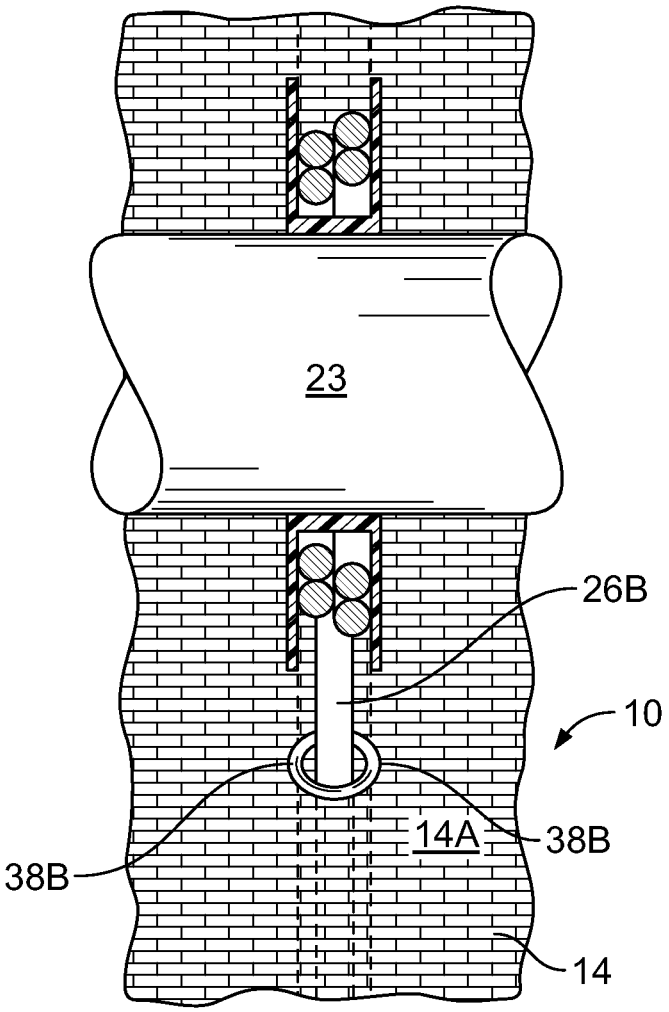
FIG. 3 comprises an enlarged fragmentary elevational front view, partly in section, of the shade 10 of FIGS. 1 and 2.
Figure 4:
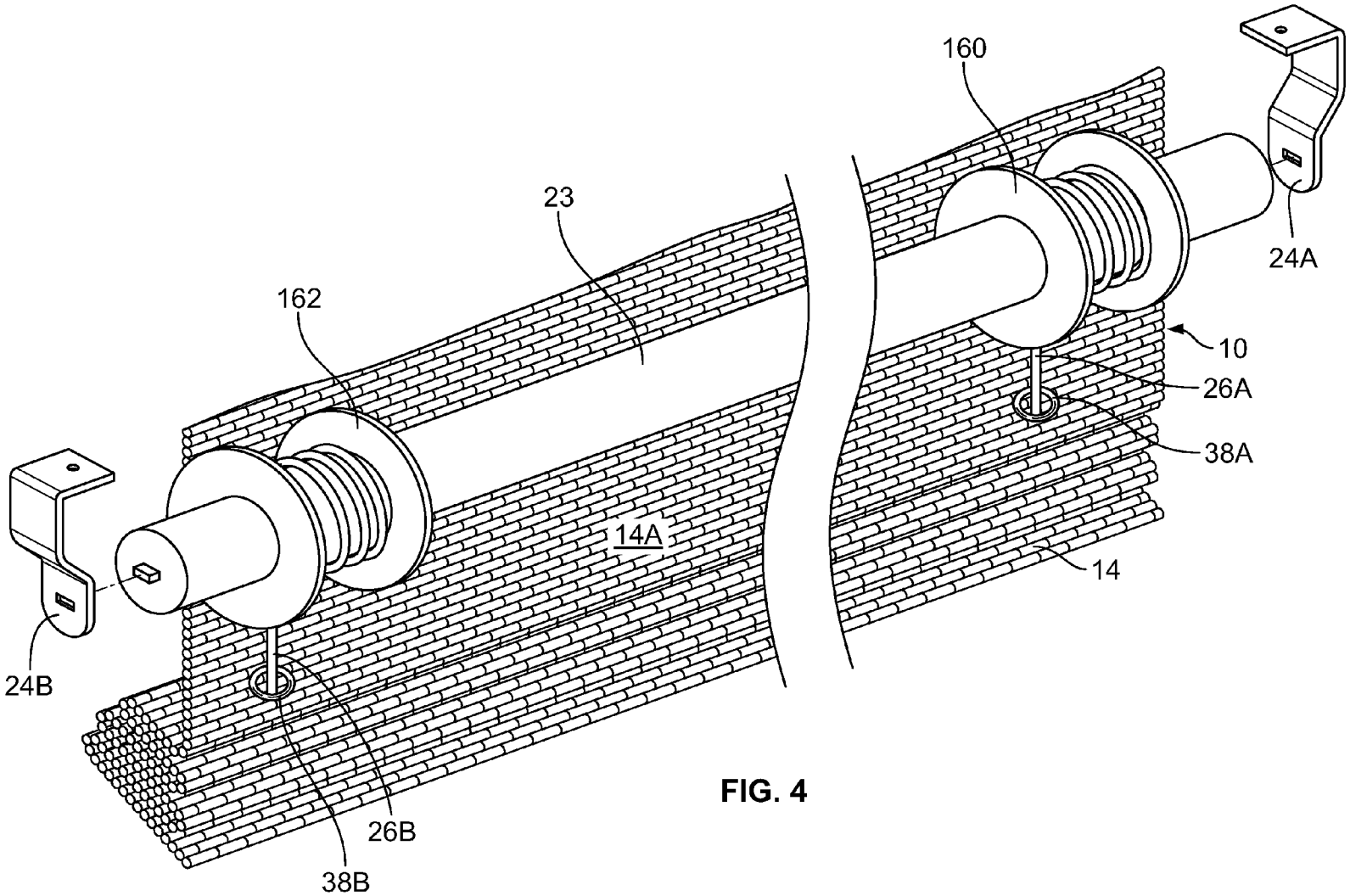
FIG. 4 comprises an exploded, fragmentary, isometric view of the shade 10 of FIGS. 1-3.
Figure 6:
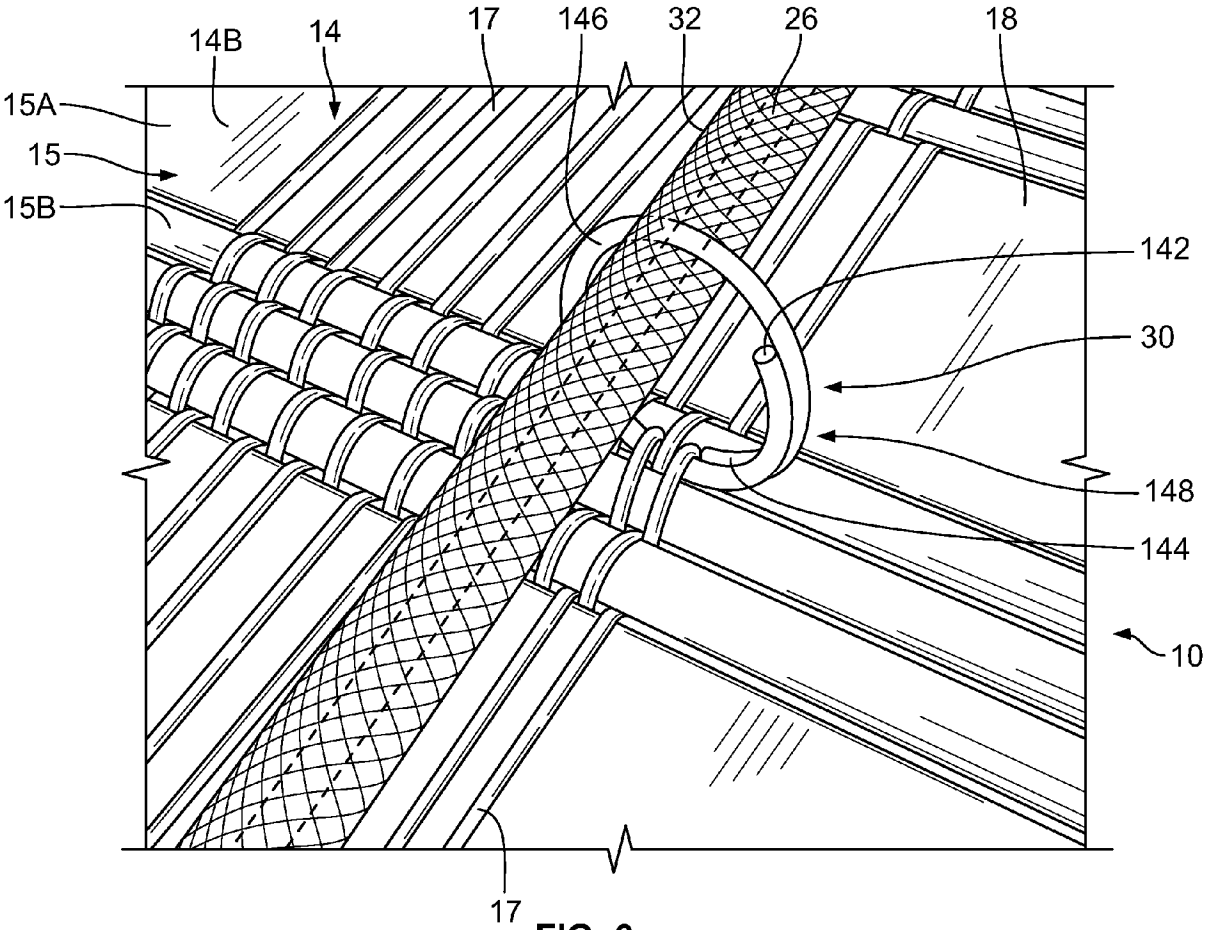
FIG. 6 comprises an enlarged, fragmentary rear isometric view of the window shade 10 of FIGS. 1-4.
Figure 5:
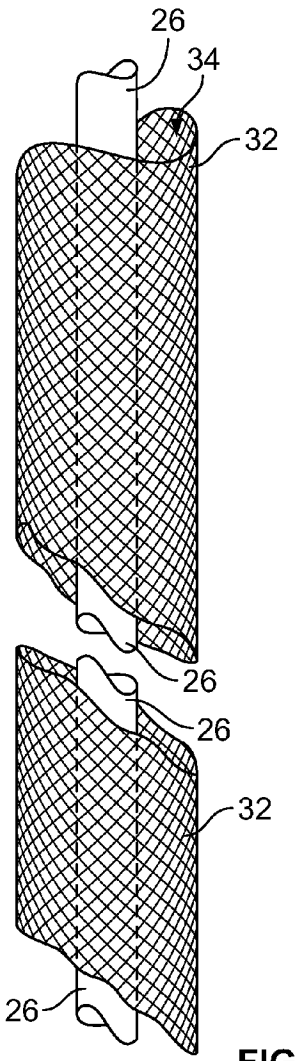
FIG. 5 comprises an enlarged, fragmentary, isometric view of the shroud 32 and encapsulated cord 26.

Referring also to FIGS. 2-5, the shade 10 further includes a mechanism 22 for raising and lowering the shading material 14 relative to the headrail 12. In the preferred embodiment, such a mechanism 22 comprises a roller 23 rotatably mounted beneath the headrail 12 by first and second side brackets 24A, 24B fastened by any suitable fasteners, such as screws 25A, 25B to the headrail 12. In the preferred embodiment, the roller 23 comprises a conventional spring-loaded shade roller conventionally used to take up and store flexible shade fabric or other shade material in wound-up fashion thereon. The roller 23 preferably includes substantially rectangular (or other shaped) rotationally spring-loaded rotatable spindles 21A, 21B that are keyed into like-shaped bores or apertures in the brackets 24A, 24B. This keying prevents relative rotation between the spindles 21 and the brackets 24 so that the spring loading of the spindles 21 permits spring forces to be transferred to the roller 23. It should be noted that the roller 23 may be rotatably mounted in another fashion and/or may be mounted to another structure, such as a window casing, as desired. Such a roller further has an internal clutch mechanism that permits a user to pull down on the shade material, position a lower end of the material, and release the material, whereupon the material remains at or moves to a stationary position at any of a plurality of discrete desired heights and is locked against further rotation that would otherwise result in further movement of the shading material. An example of such a roller 23 is sold by Frenk USA LLC of Fredericksburg, Va. One or more cords 26 (seen in the FIGS. as two cords 26A, 26B, although a different number may be used, depending upon the width of the shade 10) are secured to the rear face 14B of the shading material 14 above or adjacent the lower edge 20 of the shade portion 18. The cords 26A, 26B extend through grommets 38A, 38B that are crimped or otherwise secured about openings in the material 14. The cords transmit forces to the shading material 14, as noted in greater detail hereinafter. As discussed in greater detail below, collapsible shrouds 32A, 32B are sewn to or otherwise secured to the material 14 at spaced locations. As also illustrated in FIGS. 5 and 6, each shroud 32A, 32B preferably has a roughly tubular (i.e., hollow) shape and defines an internal passage 34A, 34B, respectively, that extends in a longitudinal direction downwardly adjacent the rear face 14B of the material 14. Each shroud 32A, 32B is loosely woven with gaps in the weave thereof. The cords 26A, 26B extend into the shrouds 32A, 32B, respectively, in the vicinity of the grommets 38A, 38B wherein each cord 26A, 26B passes through one of the gaps in the weave of the shrouds 32A, 32B. The cords 26A, 26B extend downwardly adjacent the rear face 1413 and are preferably entirely encased in the collapsible shrouds 32A, 32B between the points at which the cords 26A, 26B respectively enter the shrouds 32A, 32B in the vicinity of the grommets 38A, 38B and lowermost locations 42, 44 of attachment of the cords 26A, 26B and shrouds 32A, 32B to the material 14, as illustrated in FIG. 1. The collapsible shrouds 32 are preferably constructed so that they are able to extend longitudinally as the material 14 is lowered toward the deployed position, as evident from those portions of the shrouds 32 disposed above the folds 36 in FIG. 1. The shrouds 32 are also preferably constructed so that they are able to collapse longitudinally as the material 14 is raised toward the stowed position, as is evident from those portions of the shrouds 32 disposed within the folded section of the shade portion 18 in FIG. 1. For this reason, the shrouds 32 are preferably fabricated from a loosely woven flexible material, for example, such that the cords 26 might be seen through the gaps in the shrouds 32. The loosely woven material can be formed by a variety of materials, with low-friction polymeric yarn materials being preferred to minimize friction with the cords 26. The polymeric yarn is preferably 100% polyester, and may be woven on a crochet or knitting machine. Preferably, the cords 26 are also made of polyester material so as to minimize frictional forces and allow the cords 26 and shroud 32 to slide easily past each other without undue wear.

The shrouds 32A, 32B may be attached to the upper end 16 of the material 14 with staples that extend into the headrail 12. The shrouds 32 may alternatively or in addition be sewn, bolted, nailed, glued, or otherwise attached to the upper end 16 and/or headrail 12. In a first embodiment seen in FIGS. 1 and 2, first and second pluralities of spaced cord guides 30A, 30B, 30C, . . . , 30N and 31A, 31B, 31C, . . . , 31N, respectively, are secured to the rear face 14B of the shading material 14. In the illustrated embodiment, the cord guides 30A-30N are preferably vertically aligned with one another, as are the cord guides 31A-31N.

Each shroud 32A, 32B is preferably secured to each of an associated plurality of guides 30A-30N and 31A-31N, respectively, and is further preferably secured to the material 14 in the vicinity of the grommets 38A, 38B at the upper end 16 of the material 14. Preferably, although not necessarily, the shrouds 32 are otherwise not attached to the material 14. Each cord 26A, 26B inside of the shroud 32A, 32B, respectively, is routed through associated uppermost guides 30A and 31A located in proximity to the headrail 12, through one or more associated intermediate cord guides 30B-30N−1 and 31B-31N−1, and is attached to associated lowermost cord guide 30N and 31N nearest the lower end 20 of the material 14. The shrouds 32 and cords 26 may be tied in a knot around the lowermost cord guides 30N and 31N. Preferably, the cords 26 and shrouds 32 are knotted together to the lowermost cord guides 30N and 31N to make one cohesive knot. In other embodiments, each cord 26 and shroud 32 may be knotted separately to the same or different portions of the associated cord guide 30N, 31N. Adhesive, bonding, or other means of attachment may also or alternatively be used. In each event, the portions of the shrouds 32 and the cords 26 disposed between adjacent pairs of cord guides 30, 31 are only able to be displaced a limited distance from the shading material 14, and such distance is determined at least in part by the spacing distance between adjacent cord guides 30A-30N and 31A-31N, and the resiliency of the cords 26 and/or shrouds 32.

Alternatively, the shrouds 32A, 32B and cords 26A, 26B may extend through the cord guides 30A-30N and 31A-31N and may be secured to the material 14 at locations below the lowermost cord guides 30N and 31N. In this event, each shroud 32A, 32B is secured to the associated cord guides 30A-30N and 31A-31N, respectively, and each cord 26A and 26B optionally extends through one or more of the associated cord guides 30A-30N and 31A-31N, respectively.

Preferably, the cord guides 30, 31 are identical to one another, and each cord guide 30A-30N and 31A-31N comprises a split metal ring, for example, the ring 30 seen in FIG. 6 attached to the shade 10 of FIG. 1. Other rigid material may also be used for the cord guide 30, 31, such as (but not limited to) plastic, paper, cardboard, glass and/or wood, although the preferred material is metal, such as steel. In the illustrated embodiment, each cord guide 30, 31 is approximately 1.27 centimeters (0.5 inches) in diameter and is formed of a material about 1.067 centimeters (0.042 inches) thick.

Referring specifically to FIG. 6, each cord guide 30, 31 includes a first end 142, a second end 144 and an intermediate portion 146 that connects the first end 142 and second end 144. The first end 142, second end 144 and intermediate portion 146 form a spiral having an overlapping portion 148 defining a partial double loop. Alternatively, the material may instead be arranged to form a full double loop, a partial triple loop, a full triple loop etc. Either end 142, 144 of the loop can be pried open relative to the other end to allow shroud material 32 or weaving cords 17 to be inserted and slid along the spiral until it becomes wholly engaged onto the ring. Alternatively, each cord guide 30, 31 may use a mechanism (not shown) to open and securely close the loop.

Each cord guide 30, 31 is attached to the shade 10 by inserting the first end 142 or the second end 144 of the cord guide between the weaving cords 17 and the shading material 14 and subsequently rotating the ring until the cord guide 140 is fully engaged about the weaving cords 17, and therefore with the shade 10. Each cord guide 30, 31 may similarly be attached to the shroud 32 by inserting the first end 142 or the second end 144 of the cord guide through loosely woven shroud material 32 between weaves thereof and rotating the ring 30, 31 and/or sliding the shroud 32 along the spiral contour of the ring, until the cord guide 30, 31 is fully engaged with the shroud 32. Preferably, the cord guide 30, 31 is attached to the shroud 32 such that the respective cord 26 passes through the hollow interior of the cord guide, thereby ensuring that the cords 26 are unable to become loose or be pulled loose and hang free from the material 14 and making the shade 10 less likely to pose a risk to children or others. The strength of the attachment of the shrouds 32 to the material 14 may be important because the stronger the method of attachment, the less chance there is that a child will be able to pull the collapsible shroud 32 off of the cord guides or the cord guides off of the shading material, thereby minimizing the chance that a child will be able to place his or her head between one of the collapsible shrouds 32 or cords 26 and the adjacent rear surface 14B of the material.

Figure 2:
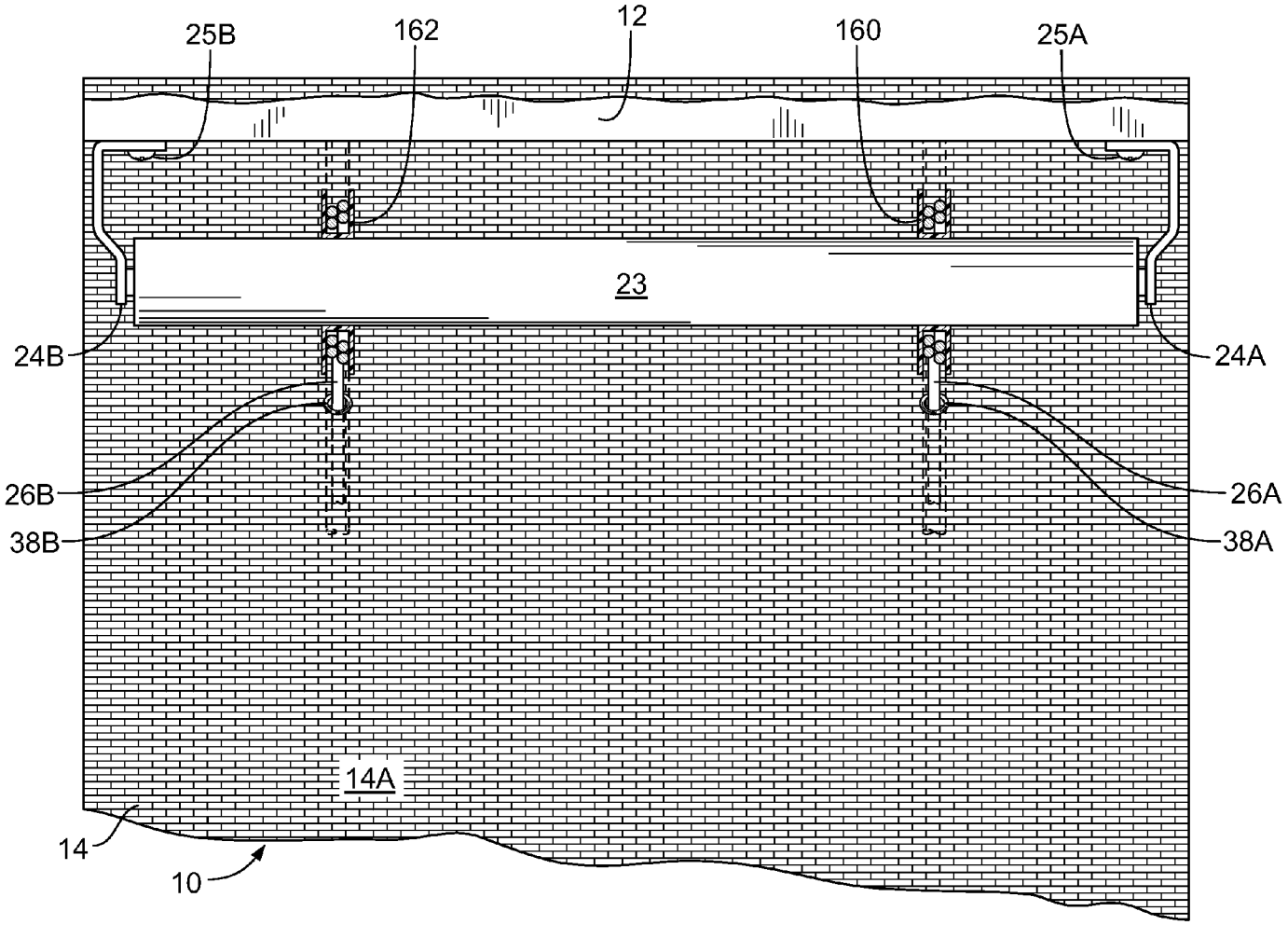
FIG. 2 comprises a fragmentary, elevational front view of the shade 10 of FIG. 1.

Referring next to FIGS. 2-4, first and second spools 160, 162 are fixed at spaced locations on the roller 23 adjacent the grommets 38A, 38B, respectively. The spools 160, 162 rotate with the roller 23 and the cords 26A, 26B are secured to the spools 160, 162, respectively. This attachment may be accomplished by threading the cords 26A, 26B through bores extending fully through the respective spool 160, 162 and the roller 23 and knotting the end of the cord 160, 162 to prevent removal of the cord from respective bore. Alternatively, any other attachment methodology anchor structure may be used. The cords 26A, 26B are wound about the spools 160, 162 and the cords 26A, 26B are kept in tension by the biasing force developed by the spring-loaded roller 23 and the weight of the shading material 14. This tension together with the clutch action of the roller 23 permit a user to grasp the shading material 14 (typically the lower end of the material 14) and pull down against the tensioning force, and thereby move the material 14 up or down. Specifically, the material may be pulled down to a desired level by the user to unwind a portion or all of the cords 26A, 26B from the spools 160, 162, respectively, and may be released, whereupon the material 14 remains substantially at the level at which the material was released due to the clutch action of the roller 23. Alternatively, the material 14 may be pulled down to release the clutch action of the roller 23 and guided to a desired higher level by the user whereupon a portion of the cords 26A, 26B are wound on the spools 160, 162, respectively, and the material 14 may thereafter be released after assuring that the clutch action of the roller 23 will prevent further roller retraction. The shade 10 is thus positioned and remains at the higher level. The spring action of the roller counterbalances at least some, if not all, of the weight of the blind so that operation is smooth and requires little to no force to be exerted by the user.

As the shade 10 is raised, the shade portion 18 collapses and collects in cascading folds 36 beneath the headrail 12 in typical fashion for Roman-type shades. As is evident from FIG. 1, the cord guides 30, 31 create the folds 36 and are disposed at corners or inflections of the folds 36 in the material 14 when the shade portion 18 is raised. While in the stowed position, the window in front of which the shade 10 is installed is typically (although not necessarily) substantially uncovered. Conversely, in the deployed position, the window in front of which the shade 10 is installed is typically (although not necessarily) substantially covered. During movement the cords 26 are able to travel freely upwardly and downwardly through the respective shrouds 32 as a result of the connection between the cords 26 and shade portion 18 being limited to a single attachment point (for example, the lowermost cord guides 30N, 31N), while the shrouds 32 have multiple connection points with the material 14 at the cord guides 30A-30N and 31A-31N.

It is preferred to encase the cords 26 within the collapsible shrouds 32 and to secure the shrouds to the material 14 at spaced locations so that the cords 26 are unable to become loose or be pulled loose and hang free from the material 14. Encapsulating the cords 26 within the collapsible shrouds 32 and securing the shrouds 32 to the cord guides 30, 31 makes the shade 10 less likely to pose a risk to children or others. To promote this safety feature further, the cord guides 30, 31 are preferably spaced sufficiently close together to preclude a child from placing his or her head between one of the collapsible shrouds 32 and the adjacent rear face 14B of the material 14. For this purpose, adjacent cord guides 30 and adjacent cord guides 31 are preferably spaced, for example, not more than eight inches (about twenty centimeters) apart, and more preferably no more than about six inches (about fifteen centimeters) apart or less.

It should be noted that the blind 10 may utilize different cord guides and/or different cord and/or shroud materials. For example, any combination of such elements disclosed in U.S. Patent Application Publication No. 2011/0100569, the disclosure of which is expressly incorporated herein, may be used in the present invention. Also, any number of shroud-encased cords 26 and associated spools may be used to assist in raising/lowering the blind 10, as necessary or desirable. Also, one or more of the cords 26 may be replaced by tapes (i.e., narrow, flat, elongate strips of material). Still further, more than one spring may be used in the roller 23 and/or one or more springs may be located outside of the roller 23, e.g., between the roller 2.3 and one or both of the brackets 24A, 24B and/or between a portion of the shading material 14 and one or both of the brackets 24, and the particular combination of springs and overall upward force exerted by the spring bias on the roller 23 may be selected in dependence upon the weight of the blind 10 and/or to achieve a particular operational effect. One spring or set of springs may be disposed at or adjacent one end of the roller 23 and another spring or set of springs may be disposed at or adjacent another end of the roller 23. Additional structures might be used to provide an upward force to permit the shading material 14 to be positioned at a desired level. For example, outwardly-facing (i.e., laterally-extending) members may be secured in any suitable fashion to the shading material 14 and may extend into slots in side members fixed to or forming a part of the side members of a window casing. Springs may be disposed in recesses communicating with the slots and may bear against the outwardly-facing members to provide an upward spring bias to the shading material 14. A clutch mechanism may be included to permit the shading material to be raised by a user to a desired level and released, whereupon the shading material remains at the desired level. Such an apparatus may be used in combination with the roller 23, if desired.

Figure 7:
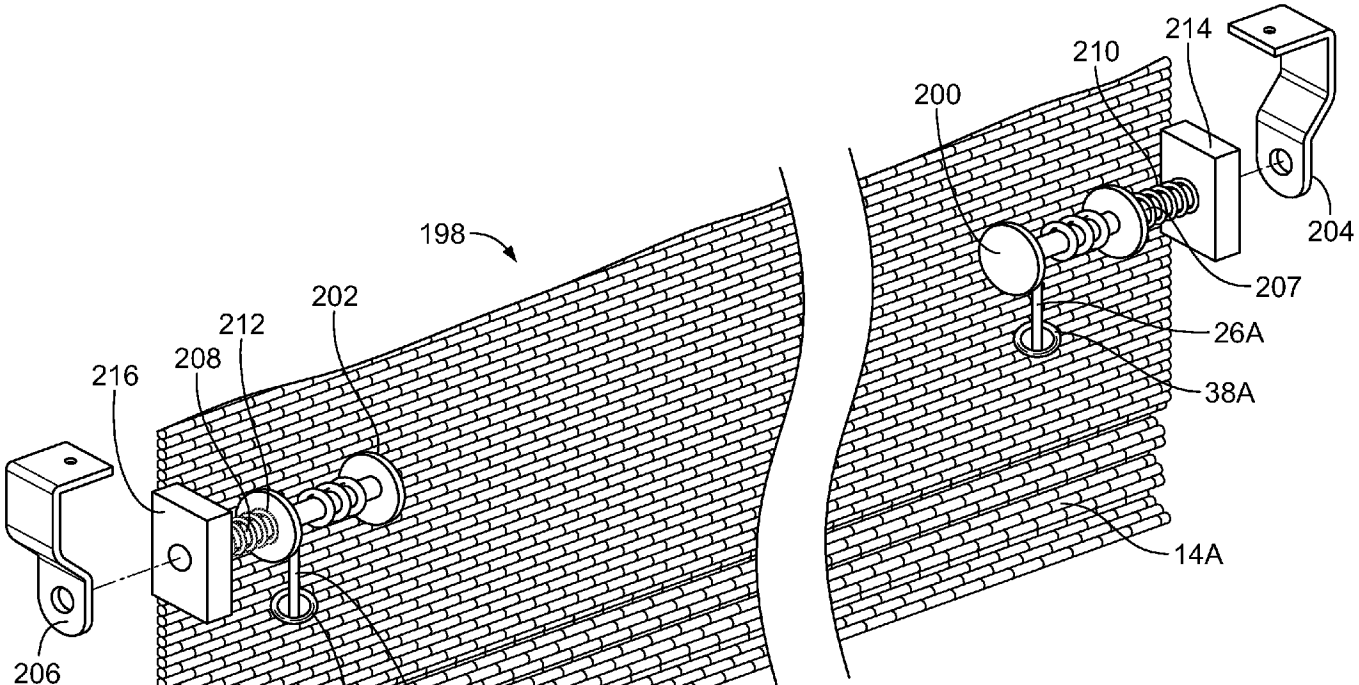
FIG. 7 comprises an exploded, fragmentary, isometric rear view of an alternate blind 198.

Still further, the precise tensioning elements that assist in the raising and lowering of the blind without the need for manually graspable cords could be changed. For example, the spring-loaded roller 23 may be replaced by a different tensioning element altogether, if desired. For example, referring to FIG. 7, a blind 198 omits the roller 23 entirely, and the cords 26 may be secured to and wound about spools 200, 202 carried by brackets 204, 206 secured to a headrail (not shown, but identical to the headrail 12 described above) and/or to a window casing (not shown). Specifically, the spools 200, 202 may be rotatably carried on spindles 207, 208, respectively, and may be spring-biased by torsion springs 210, 212, respectively. The spindles may be coupled to external clutch mechanisms 214, 216 secured by any suitable means to the brackets 204, 206, respectively. If desired one of the clutch mechanisms 214, 216 may be omitted and/or the clutch mechanism(s) may be disposed inside the spool(s) 200, 202. Again, the clutch mechanism(s) allow the shading material 14 be positioned and remain at a desired level.

Alternatively, the cords 26 may extend about pulleys and into side pockets of the window jamb or casing and may be attached to counterweights that ride up and down in the pockets, similar to the construction of casement windows roughly pre-1960's.

In any of the embodiments disclosed herein, one or more pulleys, idlers, guides, etc. may be used in the path of the cords 26, as necessary or desirable regardless of the tensioning element that is used.

Figure 9:
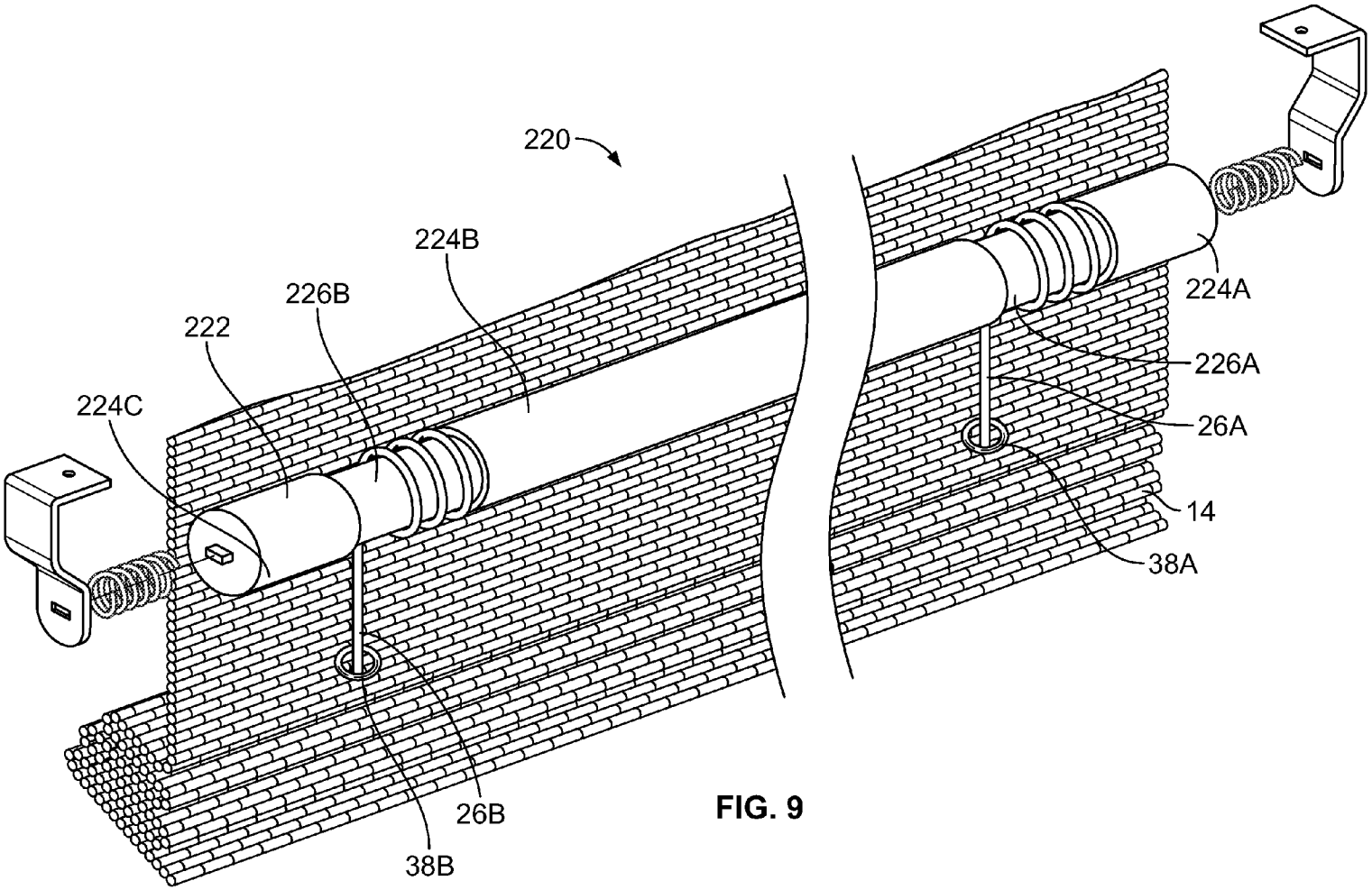
FIG. 9 comprises an exploded, fragmentary, isometric rear view of an alternate window shade 220.

Also, the spools of the embodiment of FIGS. 1-4 may be replaced by other elements or omitted altogether, in which case the cords 26A, 26B may be secured directly to the roller 23 and may be wound thereon. The roller 23 may have guiding structures to guide the cords 26 as the cords are taken up and wound about the roller 23. The roller 23 may have any suitable dimensions and shape; for example, the roller may have a diameter larger or smaller that that shown in the FIGS. and need not have a constant diameter over the full length thereof. Such a shade 220 is illustrated in FIG. 9, which illustrates a roller 222 having main portions 224A-224C and reduced diameter portions 226A, 226B between the main portions 224A, 224B and 224B, 224C, respectively. The cords 26A, 26B are secured in any suitable fashion such as that described above to the reduced diameter portions 226A, 226B, respectively, and wound thereabout. The roller 222 may have internal springs and/or may be coupled by external torsion springs 230, 232 to brackets 234, 236, respectively. The roller 222 may have an internal clutch mechanism as in the embodiment of FIGS. 1-4 and may operate identically thereto, with the exception that the cords are not taken up by spools, but are instead collected in loops in the reduced diameter portions 226A, 226B.

Figure 10:
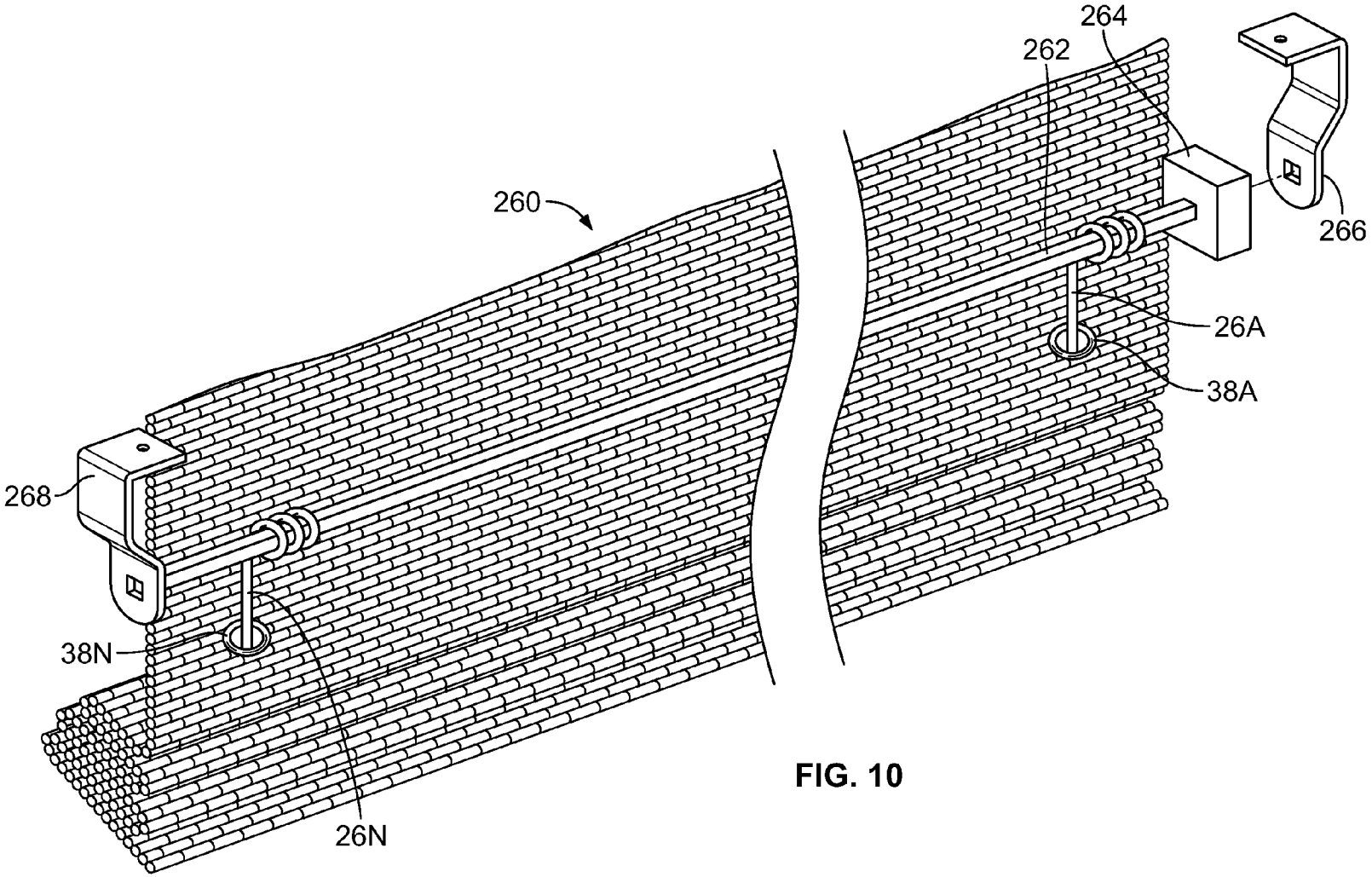
FIG. 10 comprises an exploded, fragmentary, isometric rear view of a further alternate window shade 260.

Still further, the roller 23 may be replaced by a stationary housing and rotatable element(s) may be disposed within the housing to which the cords 26A, 26B are secured and about which the cords 26A, 26B are wound. As yet another alternative, the roller 23 may be replaced by a shaft that is journaled in the window frame or between two other elements for rotation. Such an arrangement is shown in FIG. 10, in which a shade 260 includes a shaft 262 and a combined spring/clutch mechanism 264 mounted between mounting brackets 266, 268. As in the previous embodiments, the brackets 266, 268 are secured in any suitable fashion to a window casing, and cords 26A, 26B, . . . , 26N are secured in any suitable manner to the shaft 262 (such as through bores in the shaft 262 and knotted to prevent removal therefrom). The cords 26 may be wound directly around the shaft (as shown) or about one or more elements carried by the shaft. This embodiment otherwise operates exactly as the embodiment of FIG. 9 with the spring-loading and the clutch operation provided by the mechanism 264. Of course, such operation may be provided by separate clutch and one or more springs, as described previously.

Figure 8:
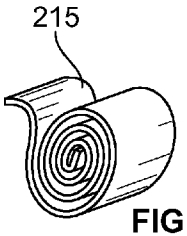
FIG. 8 comprises an enlarged, fragmentary, isometric view of a flat spring 215.

While the springs described hereinabove are shown as coil springs, any of the springs disclosed herein may comprise flat springs as illustrated by the spring 215 of FIG. 8. As should be evident, any type of spring(s) suitable for the purpose of providing a counteracting force to oppose the weight of the shading material may be used, including, but not limited to torsion springs, tensioning springs, compression springs, or the like.

Figure 11:
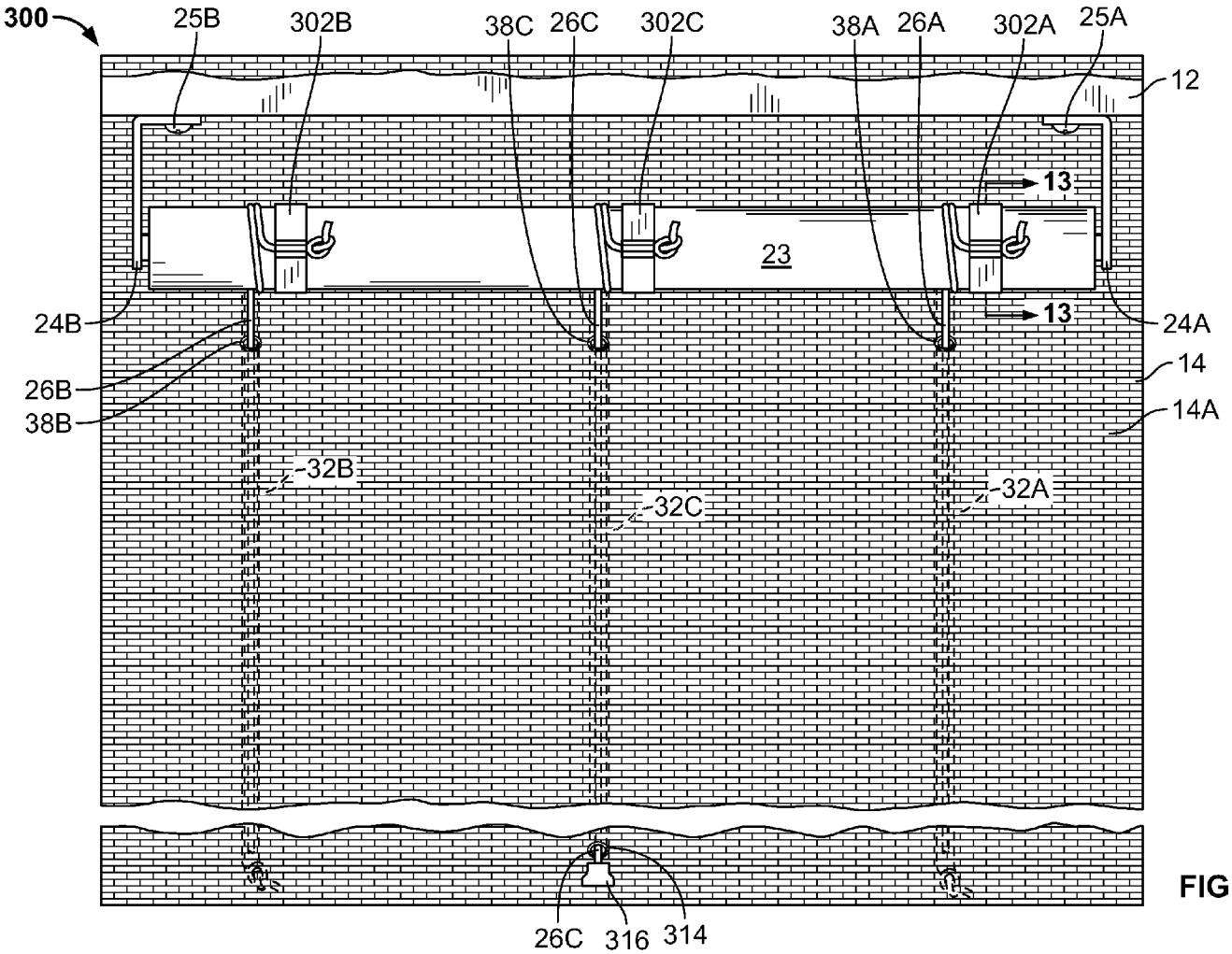
FIG. 11 comprises a fragmentary, devotional view of yet another embodiment of the present invention.
Figure 12:
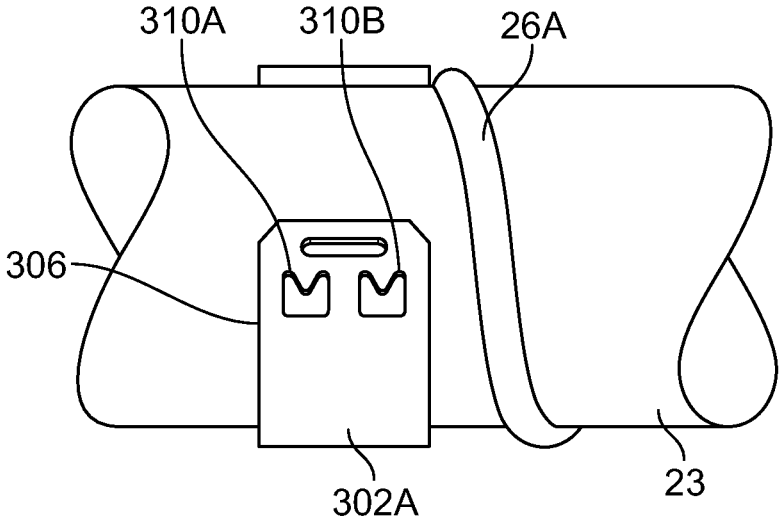
FIG. 12 comprises an enlarged, fragmentary, elevational view illustrating the clip of FIG. 11 in greater detail.
Figure 13:
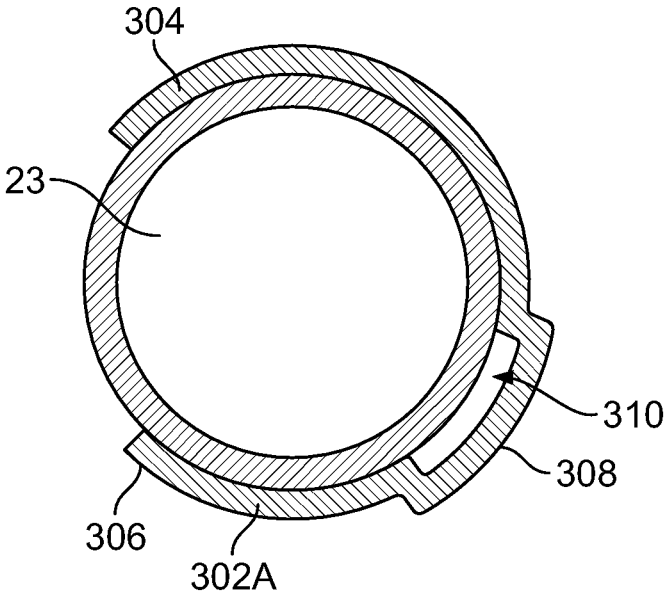
FIG. 13 comprises a sectional view taken generally along the lines 1343 of FIG. 11.

FIGS. 11-13 illustrate yet another embodiment wherein three cords 26A, 26B, 26C extend through shrouds 32A, 32B, 32C, respectively, and grommets 38A, 38B, 38C, respectively. The cords 26A-26C are wound about the roller 23 at spaced locations and are secured to the roller 23 by clips 302A-302C, respectively. (The brackets 24A, 24B are shown as being of L-shape in FIG. 11, it being understood that the brackets 24 may be of any desired shape in any of the embodiments disclosed herein). The clips 302A-302C are identical, and hence only the clip 302A is described in detail herein. As seen in FIG. 13, the clip 302A includes first and second arms 304, 306 and an intermediate portion 308 of increased diameter relative to the arms 304, 306. The intermediate portion 308 defines a circumferential space 310 through which the cord 26A may extend. The cord 26A may be knotted about the intermediate portion 308 or may be knotted to itself on a side of the portion 308 to secure the cord 26A to the roller 13. Each of the arms 304, 306, for example the arm 306 as seen in FIG. 12, includes one or more spiked portions 310A, 310B, that may be bent into engagement with the roller 23 to secure the clip 302A against rotation relative to the roller 23.

The cord 26C extends downwardly through the shroud 32C, exits the shroud 32C and extends outwardly through a further grommet 314 where it is accessible at the front face 14A of the material 14. A bell-shaped handle 316 made of wood, plastic, or any other suitable material may be secured to the cord 26C in any suitable manner, such as by extending the cord 26C through a bore in the handle 316 and knotting the cord 26C, to assist a user in actuating the shade 300. The shroud 32C and cord 26C is preferably secured using cord guides 29A, 29B, 29C, . . . , 29N (see, for example, FIG. 19) as disclosed in any of the embodiments hereinabove to spaced points of the rear face 14B of the material 14 similar or identical to the connection of the shrouds 32A, 32B and the cords 26A, 26B.

In use, a user grasps the handle 316 and pulls downwardly, thereby releasing the clutch mechanism in the roller 23 and causing the roller 23 to rotate and thereby wind or unwind the cords 26. The user can prevent further winding or unwinding of the cords 26 by exerting a downward force on the cord 26C via the handle 316, thereby stopping the rotation of the roller 23 and permitting positioning of a lower edge of the shade 300 at a desired height.

Figure 14:
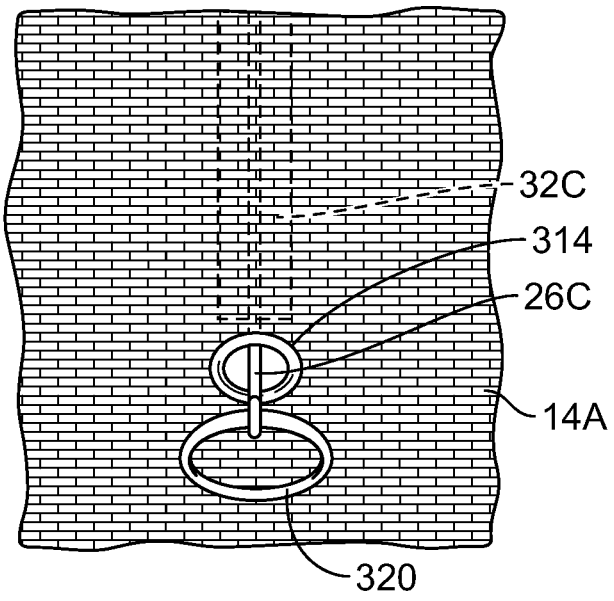
FIGS. 14, 15, 25, 26, 28, and 29 are fragmentary, enlarged, elevational views illustrating further embodiments of the present invention.
Figure 15:
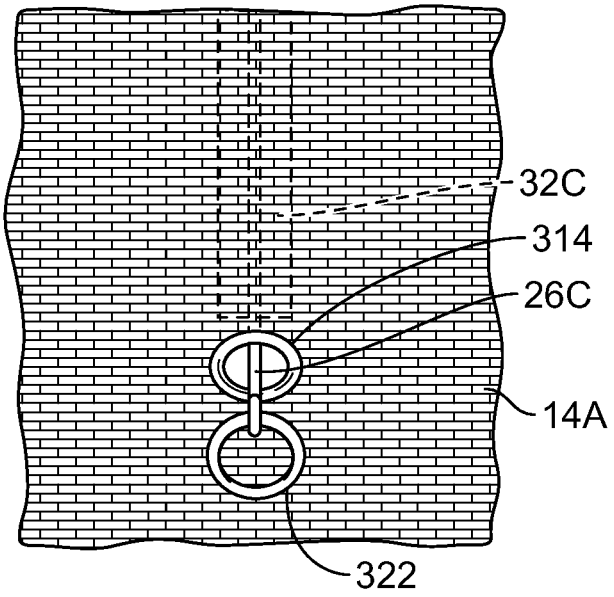
Figure 25:
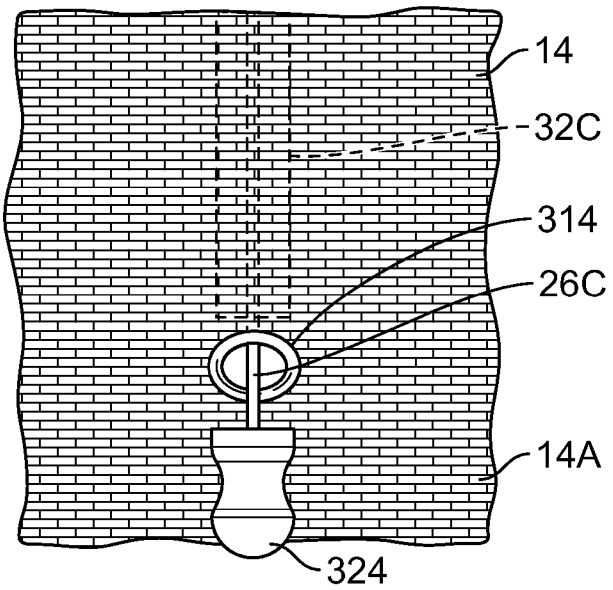
Figure 26:
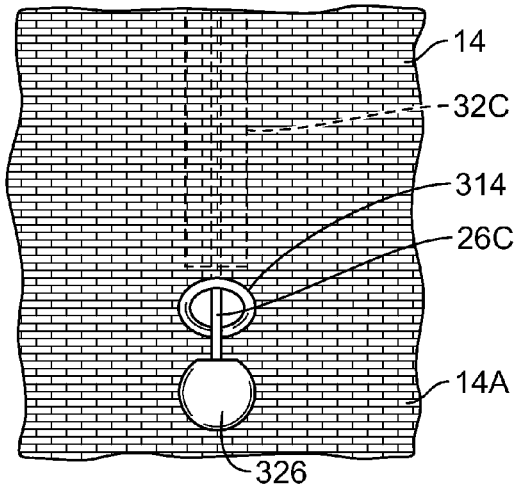
Figure 28:
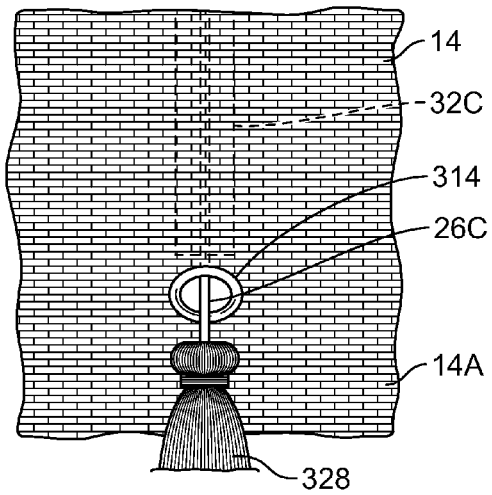
Figure 29:
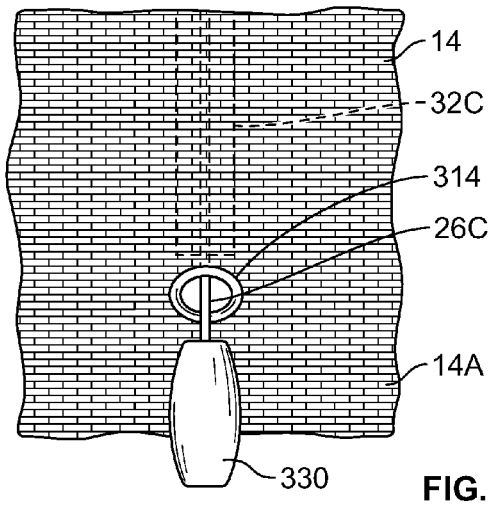

If desired, the raising and lowering operation may occur in response to force being applied to one of the other cords 26A or 26B, in which case such cord extends through a grommet appropriately positioned in the material 14 so that the cord is accessible from the front of the shade 300. Still further, with reference to FIGS. 14, 15, and 25, the bell-shaped handle 316 may be replaced by other handle(s), such as an oval-shaped handle 320 (FIG. 14), a circular-shaped handle 322 (FIG. 15), a partial dumbbell-shaped handle 324 (FIG. 25), a truncated or non-truncated ball-shaped handle 326 (FIG. 26), a tassel 328 (FIG. 28), a partial oval solid knob 330 (FIG. 29), etc.

Figure 16:
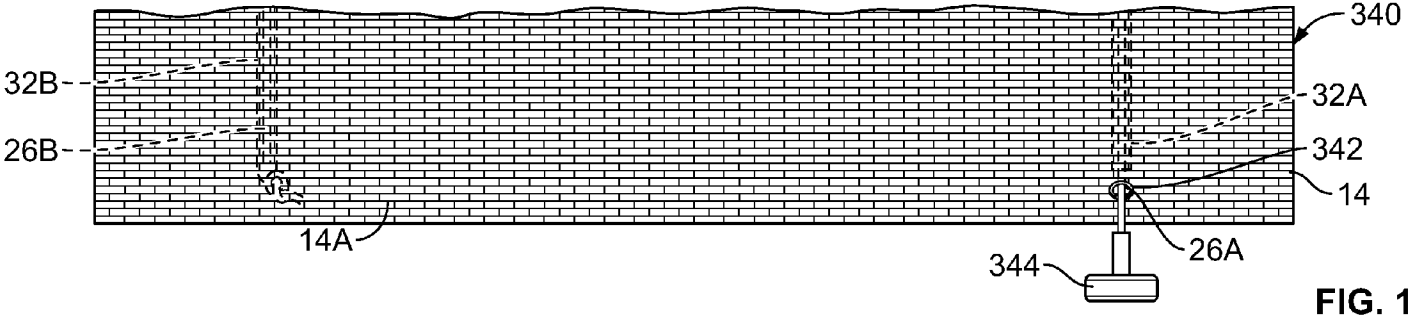
FIG. 16 is a fragmentary elevational view illustrating yet another embodiment of the present invention.

FIG. 16 illustrates a shade 340 that includes the cords 26A, 26B encased in the shrouds 32A, 32B, respectively. Though not shown in FIG. 16 (and other FIGS.), the cords and shrouds of any or all of the embodiments disclosed herein, including the cords 26A, 26B and shrouds 32A, 32B, are preferably secured using cord guides 31A, 31B, 31C, . . . , 31N and 30A, 30B, 30C, . . . , 30N as disclosed in any of the embodiments hereinabove to spaced points of the rear face 14B of the material 14. The cord 26A extends outwardly from the shroud 32A at a lower end thereof and further extends through a grommet 342 in the material 14 such that the cord 26A is accessible from the front face 14A of the material 14. A T-shaped handle 344 is secured by any convenient means (such as by a knot as described above) to the cord 26A. Although not shown, the cords 26A, 26B are wound about a roller 23 as in any of the preceding embodiments and are secured thereto to permit the handle 344 to be grasped and pulled downwardly, and thereby permit take-up of the cords 26A, 26B so that the shading material 14 can be positioned at any desired height. As in all of the embodiments described herein, the shrouds 32A, 32B and cords 26A, 26B are secured at spaced points to the rear face 14B of the material 14 to prevent a dangerous loop from being formed.

Figure 17:
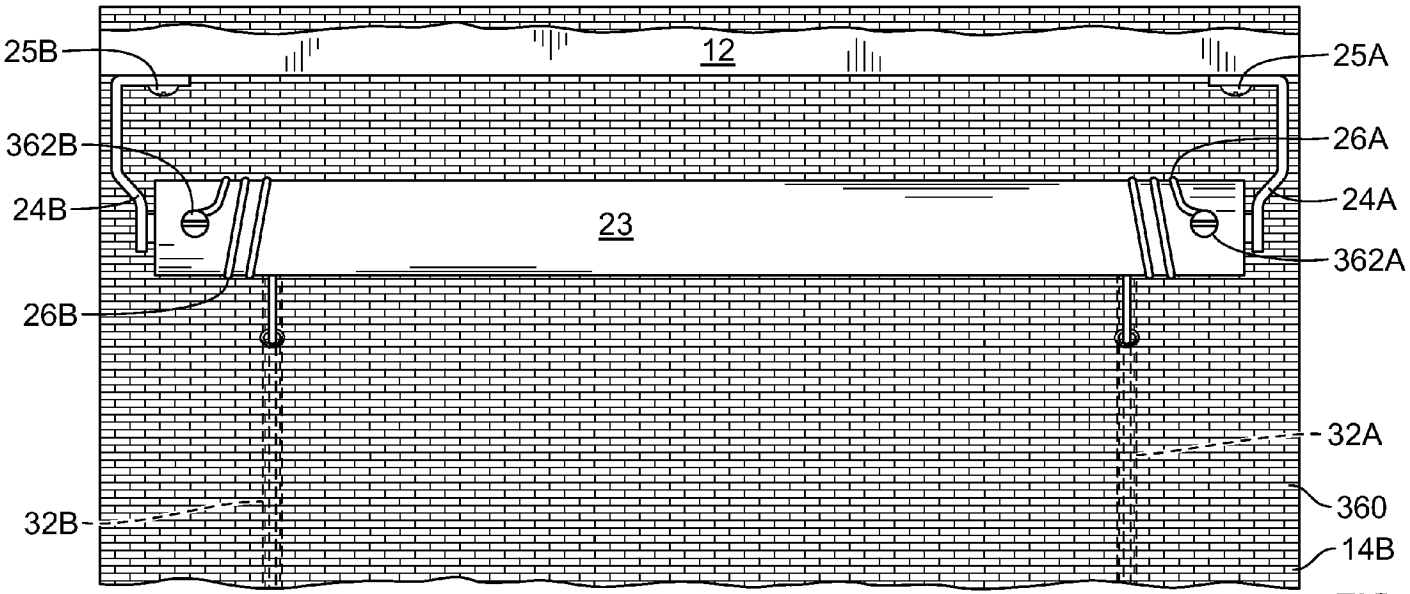
FIG. 17 is a fragmentary elevational view illustrating still another embodiment of the present invention.

FIG. 17 illustrates an alternative manner of attachment of the cords 26 to the roller 23. In the illustrated embodiment, a shade 360 otherwise similar or identical to any of the embodiments disclosed above, includes a roller 23 having first and second fasteners in the form of screws 362A, 362B that extend into the roller 23 and anchor the cords 26A, 26B thereto. Any other suitable fastener or other device may be used to anchor the cords 26A, 26B, as desirable.

Figure 18:
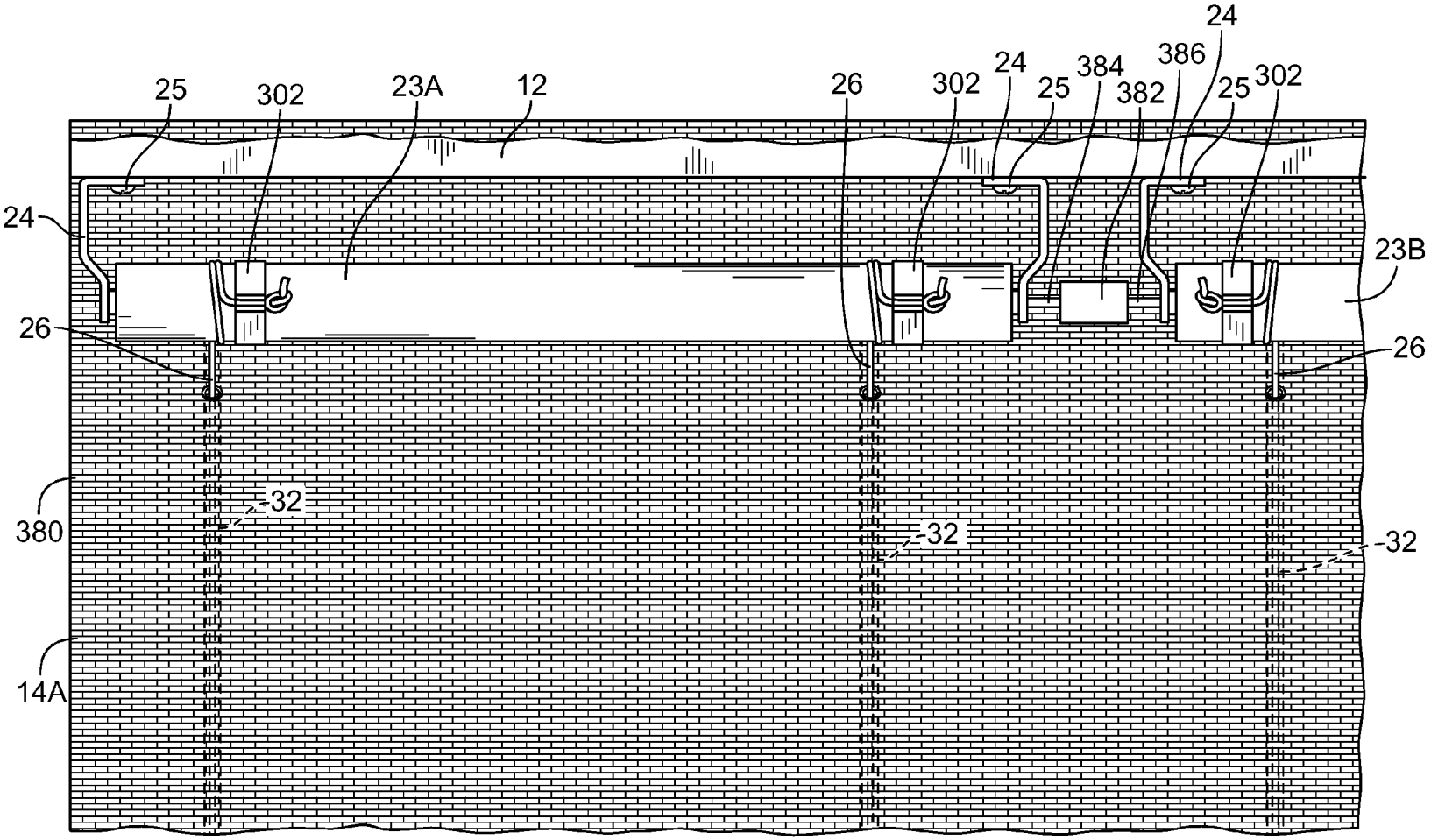
FIG. 18 is a fragmentary view illustrating another embodiment of the present invention utilizing multiple rollers.

FIG. 18 illustrates a shade 380 of substantial width. In this embodiment, two or more rollers 23A, 23B, . . . , 23N (only the rollers 23A and 23B are shown) are suspended from the head rail 12 by brackets 24, as the other embodiments described herein. Cords 26 extend through shrouds 32 and are further anchored to the rollers 23 by clips 302, as described in connection with the embodiment of FIG. 11. The rollers 23 are connected together for common movement by a gearbox or other transmission member 382 that is connected by shafts 384, 386 between adjacent rollers 23. The embodiment of FIG. 18 otherwise is similar or identical to the embodiments of the preceding figures.

Figure 27:
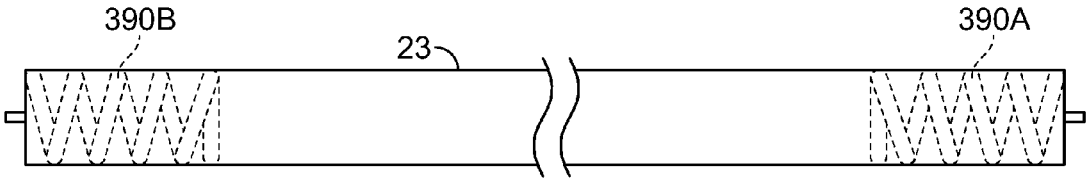
FIG. 27 comprises an elevational view of a roller having springs disposed therein for use with the shade of FIG. 18.

Alternatively, the cords 26 of the shade 380 may be wound about a single roller having one or more internal or external torsion springs that provide sufficient spring force to lift the material 14. For example, as seen in FIG. 27, a single roller 23 may include a pair of internal springs 390A, 390B that are coiled in opposite directions and are disposed in opposite ends of the roller 23. The springs 390A, 390B exert forces in an upward direction to counteract the substantial weight of the material 14. It should be noted that the clutch mechanism that allows the material 14 to be positioned at a desired height is not shown in FIG. 27.

Figure 22:
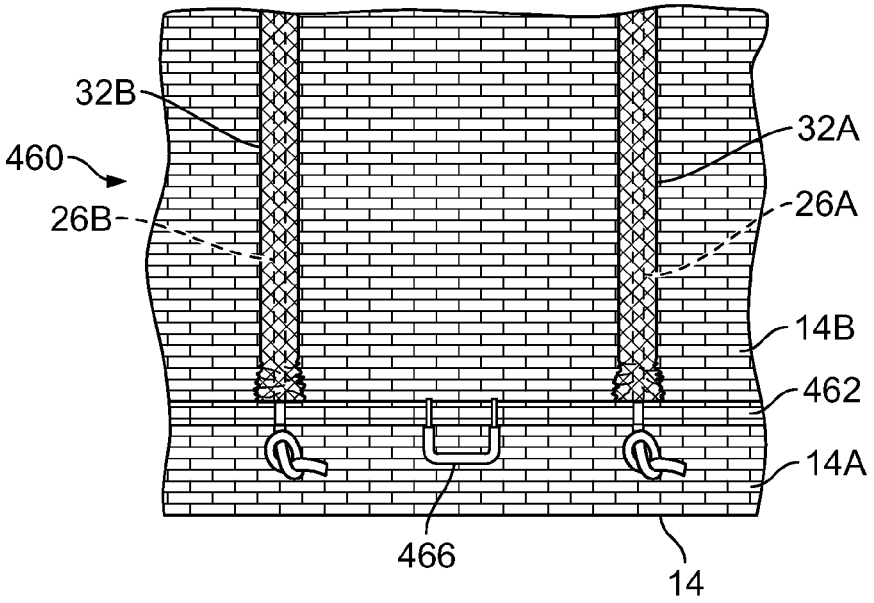
Figure 23:
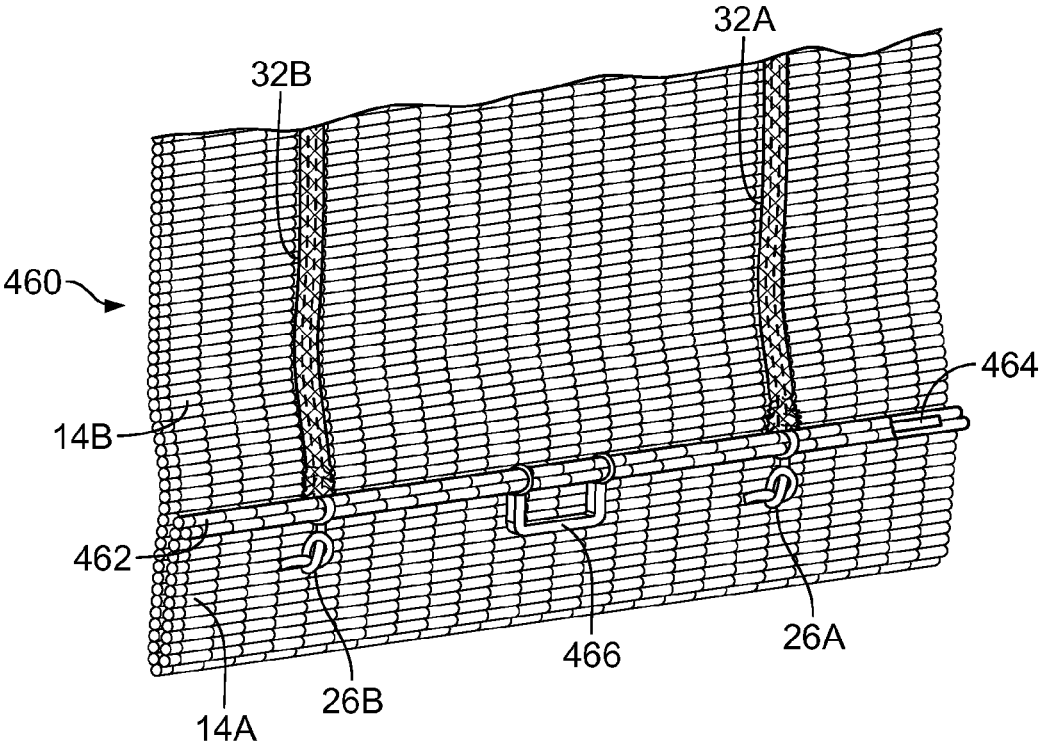
FIG. 23 comprises an isometric view of the shade of FIG. 22.
Figure 24:
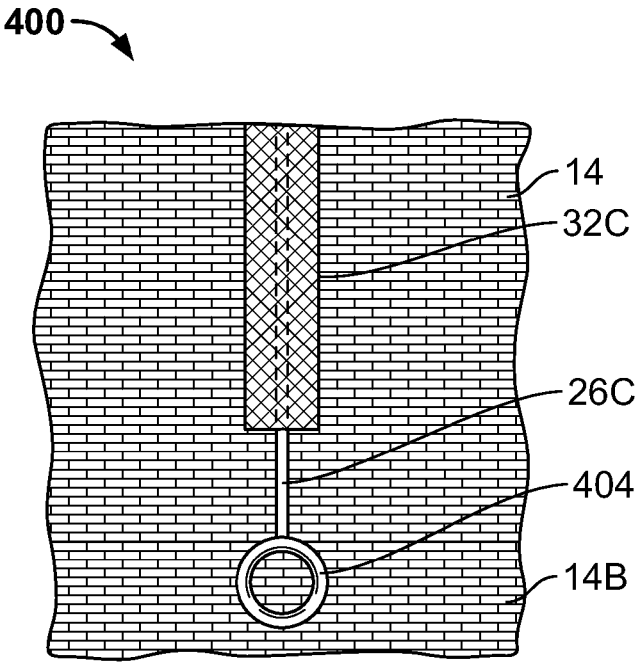

FIGS. 19-24 illustrate embodiments whereby a handle or other actuating member is accessible from the rear face 14B of the material 14. For example, with reference to FIG. 19, a shade 400 includes a T-shaped handle 402 secured in any suitable manner (such as by a knot) to the cord 26C. As seen in FIG. 24, the T-shaped handle 402 may be replaced by a ring 404 (or any other handle including, but not limited to, the handles disclosed in any of the embodiments described herein) that is tied to or otherwise secured to the cord 26C (or any other cord). In use, a user reaches behind the shade 400 and grasps the handle 402 or 404. The user may then pull down on the handle 402 or 404 to raise or lower the shade in the manner described previously.

Figure 19:
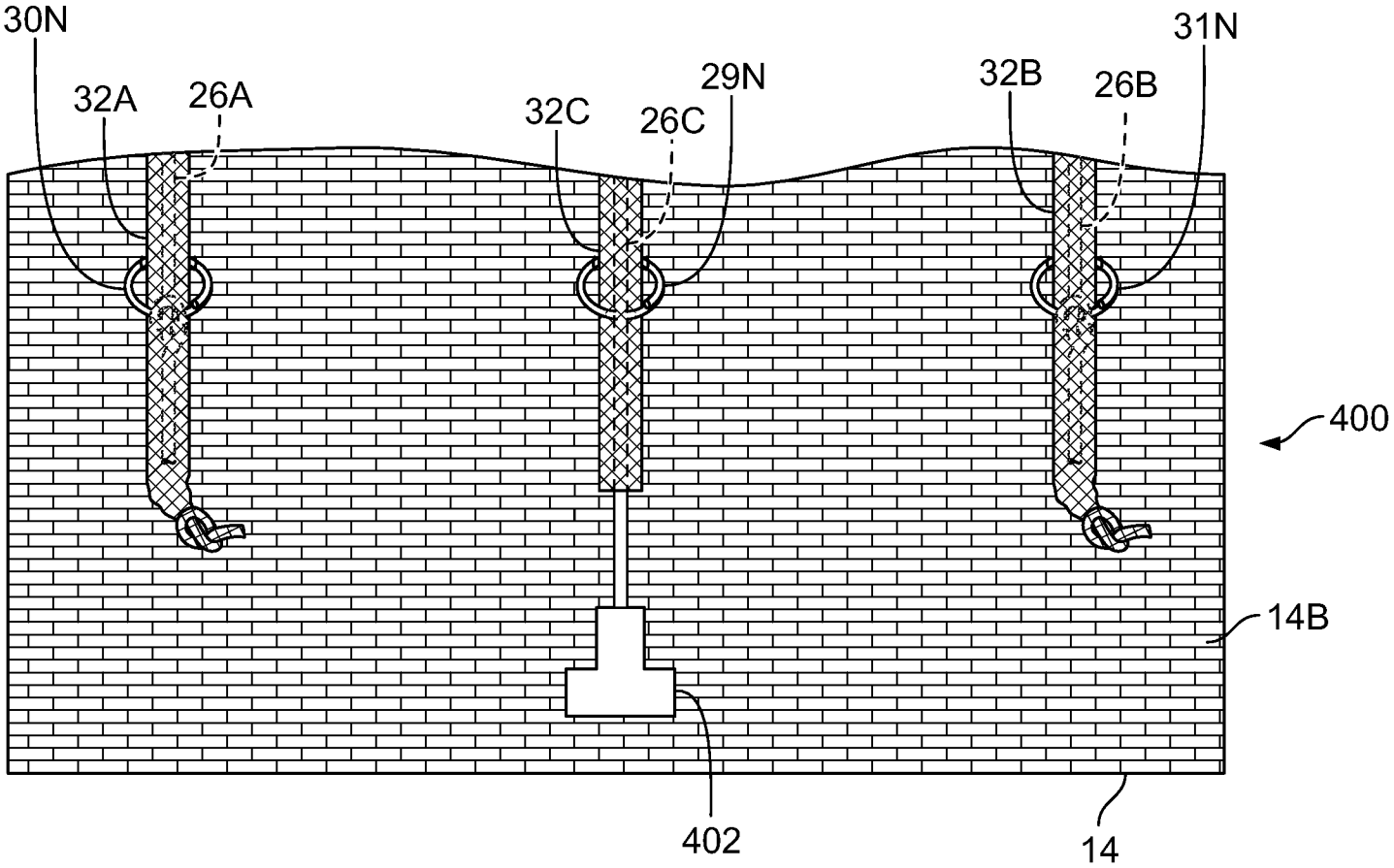
FIGS. 19 and 24 are fragmentary elevational views illustrating other embodiments of the present invention.
Figure 21:
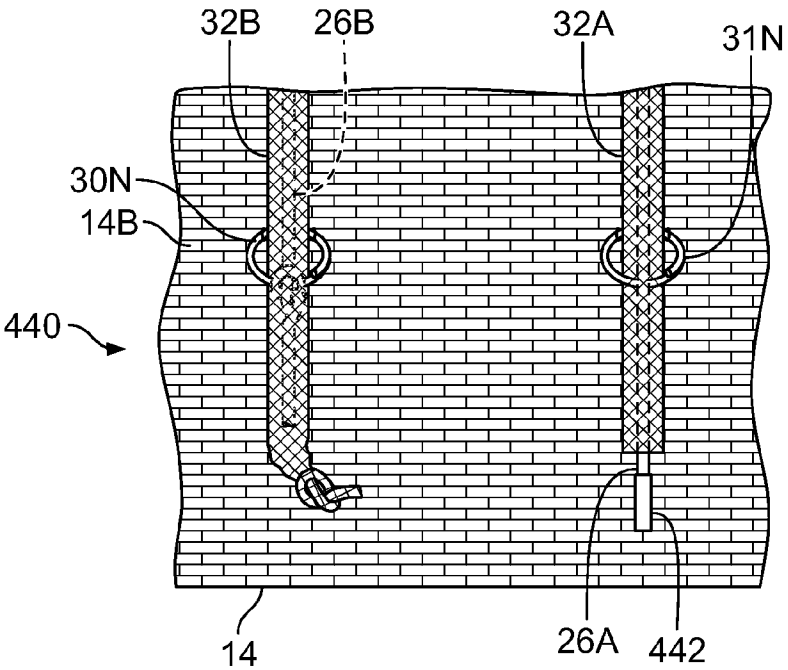
FIGS. 20-22 are fragmentary, elevational views illustrating still further embodiments of the present invention.
Figure 20:
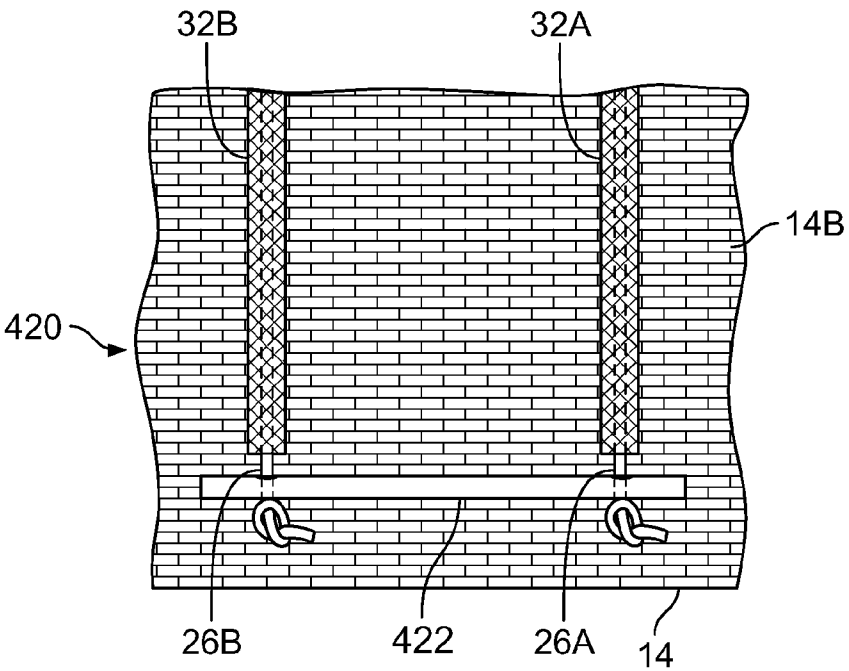

FIGS. 20 and 21 illustrate alternative arrangements to that shown in FIG. 19. In FIG. 20, as in FIG. 19, the cords 26A, 26B and shrouds 32A, 32B are preferably secured using cord guides 31A, 31B, 31C, . . . , 31N and 30A, 30B, 30C, . . . , 30N as disclosed in any of the embodiments hereinabove to spaced points of the rear face 14B of the material 14. FIG. 20 illustrates a shade 420 that includes a handle in the form of a bar 422 that spans the space between the cords 26A, 26B. The cords 26A, 26B may extend through spaced bores in the bar 422 and may be knotted or otherwise secured in any suitable fashion to fix the bar 422 to the cords 26A, 26B. In this embodiment, a user may reach behind the shade 420, grasp the bar 422, and pull downwardly as described previously to adjust the height of the shade 420.

FIG. 21 illustrates a shade for 420 including a handle in the form of a cylinder 442 made of acrylic plastic or other material wherein the cord 26A (or any other cord 26) extends partially or fully through a bore in the cylinder 442 and is knotted thereto. Though not shown, the cords 26A, 26B and shrouds 32A, 32B are preferably secured using cord guides 31A, 31B, 31C, . . . , 31N and 30A, 30B, 30C, . . . , 30N as disclosed in any of the embodiments hereinabove to spaced points of the rear face 14B of the material 14. Again, the cylinder 442 is grasped and pulled downwardly by a user to raise or lower the shades 440.

FIGS. 22 and 23 illustrate an embodiment comprising a shade 460 wherein an end 462 of the material 14 is hemmed or otherwise folded back and joined to itself to create a pocket that receives a stiffener, such as a wooden or plastic rod 464 (FIG. 23). The stiffener 464 is retained in the hemmed end 462 in any suitable fashion, such as by stitching the side edges of the end 462 shut. The cords 26A, 26B are looped around the hemmed edge 462 (the material 14 is loosely woven or otherwise can allow the cords 26 to pass therethrough) and the cords 26A, 26B are knotted or otherwise secured to the end 462. Though not shown, the cords 26A, 26B and shrouds 32A, 32B are preferably secured using cord guides 31A, 31B, 31C, . . . , 31N and 30A, 30B, 30C, . . . , 30N as disclosed in any of the embodiments hereinabove to spaced points of the rear face 14B of the material 14. A handle 466 is secured by any convenient means, such as a rope or thread about the end 462 (again, the material 14 permits passage of the rope or thread therethrough to permit securing of the handle 466). In use, the user reaches behind the shade 460, grasps the handle 466 and pulls downwardly to permit the material 14 to be positioned at a desired height.

Figure 30:
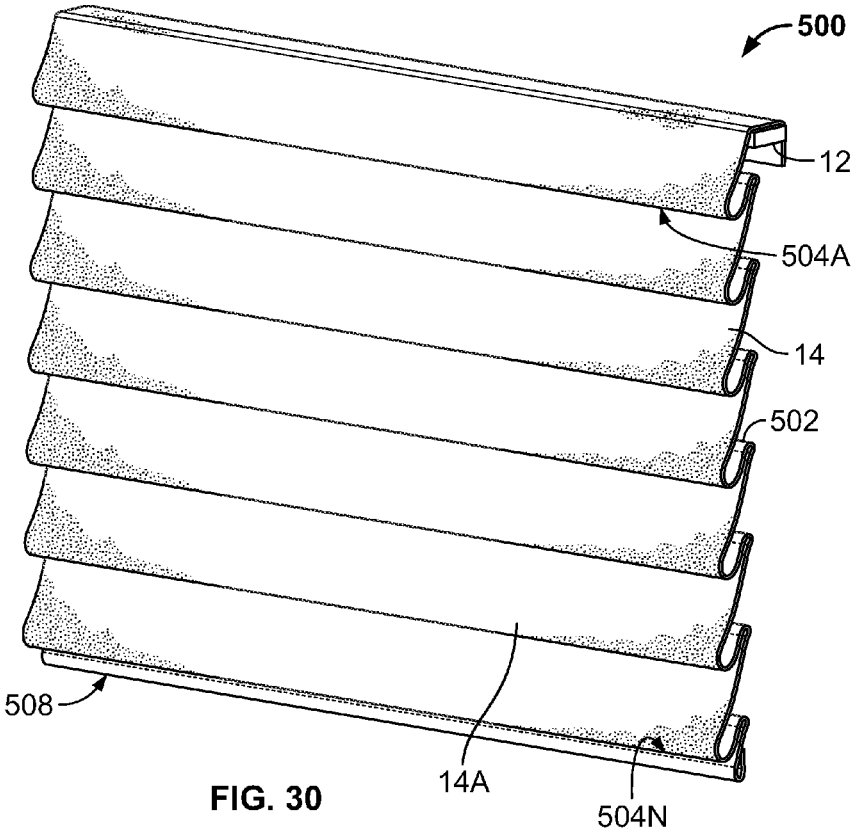
FIG. 30 is a front isometric view illustrating another embodiment of the present invention.
Figure 31:
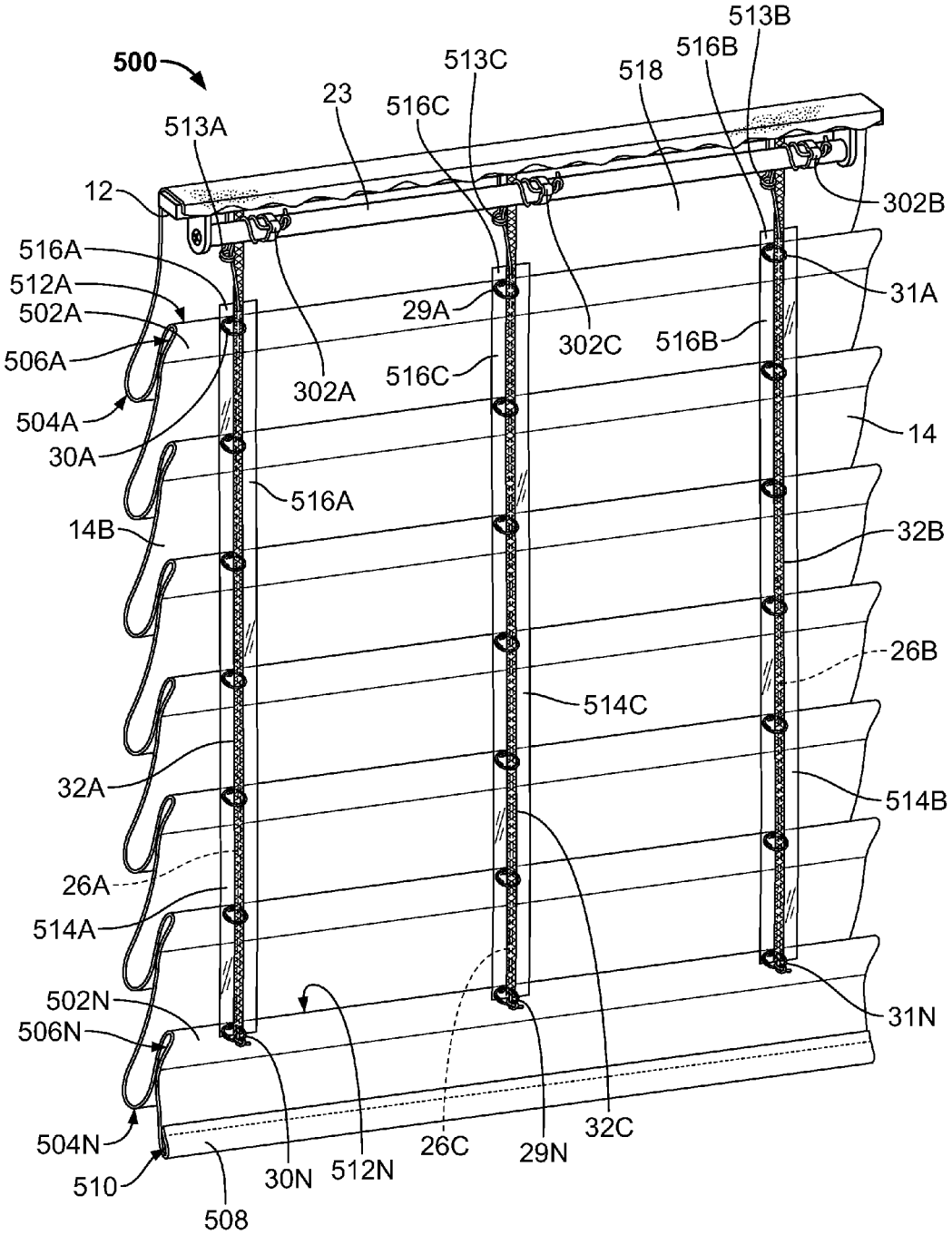
FIG. 31 is a rear isometric view of the shade of FIG. 30.

FIGS. 30 and 31 illustrate another embodiment comprising a shade 500 wherein the material 14 extends downwardly to form cascades or waterfalls of fabric off the headrail 12. The material 14 is hemmed, gathered, or otherwise folded hack and joined to itself to create a series of hemmed edges 502A, 502B, . . . , 502N on the rear face 14B of the material 14 and a series of decorative folds 504A, 504B, . . . , 504N on the front face 14A of the material 14. The hemmed edges 502 create pockets 506A, 506B, . . . , 506N that may receive stiffeners, such as a wooden or plastic rod or dowel (not shown). A bottom hemmed edge 508 also creates a bottom pocket 510 that may receive a weight bar, such as a wooden, metal, or plastic rod or dowel (not shown), to hold the bottom hemmed edge down. The cords 26A, 26B, 26C and shrouds 32A, 32B, 32C are preferably secured at spaced points on the rear face 14B of the material 14 using cord guides 29A, 2913, 29C, . . . , 29N, 30A, 30B, 30C, . . . , 30N, and 31A, 31B, 31C, . . . , 31N as disclosed in the embodiments hereinabove. Cord guides 29, 30, and 31 are attached to corresponding outer edges 512A, 512B, 512C, . . . , 512N of the pockets 506A, 506B, 506C, . . . , 506N, respectively. The shrouds 32 are attached at one end to the head rail 12 and at the opposite end to the cord guides 29N, 30N, 31N. The cords 26A, B, C exit the shrouds 32 just above cord guides 30A, 31A, 29A, respectively, and pass through cord brackets 513A, B, C, respectively, before wrapping around the roller 23. The cord brackets 513A, B, C can be made of any suitable material such as metal or plastic. Furthermore, the cords 26 are attached to the roller 23 at one end and, at the opposite end, the cords 26A, 26B, 26C may be knotted or otherwise secured to the cord guides 30N, 31N, 29N, respectively. Although three sets of cords, shrouds, and cord guides are shown and discussed, it is contemplated that any number of cords, shrouds, and cord guides could be used. As shown in FIG. 31, strips 514A, 514B, 514C may be used to prevent the folds 504 from flattening or straightening out. Upper ends 516A, 516B, 516C of the strips 514A, 514B, 514C, respectively, are attached to an upper portion 518 of rear face 14B of material 14. The strips 514 are disposed behind the shrouds 32, such that the strips 514 are situated between the rear face 14B of the shade material 14 and the shrouds 32. The strips 514 extend down the rear face 14B of the material 14 and are fastened by any suitable means such as stitching or glue to the outer edges 512 of the pockets 506 at fixed points. The strips 514 may be made of a durable and flexible light-weight material such as a suitable plastic or fabric. Although three strips 514A, 514B, 514C are disclosed, it is contemplated that any number of strips 514 may be used.

A roller, shaft, or any of the aforementioned mechanisms used to raise or lower the shade can be used with the embodiment shown in FIGS. 30 and 31. Specifically, in this embodiment the roller, shaft, or other mechanism is attached to the underside of the headrail 12 and is disposed adjacent the rear face 14B the material 14 so that the front face 14A of the material falls unobstructed from the headrail 12 to create a continuous waterfall. Alternatively, the roller, shaft, or other mechanism may be disposed adjacent the front face 14A of the material 14, and a valance (not shown) may drape downwardly in front of the headrail to hide same. Moreover, any one of the aforementioned handle types and styles may be used with the shade embodiment shown in FIGS. 30 and 31.

Figure 32:
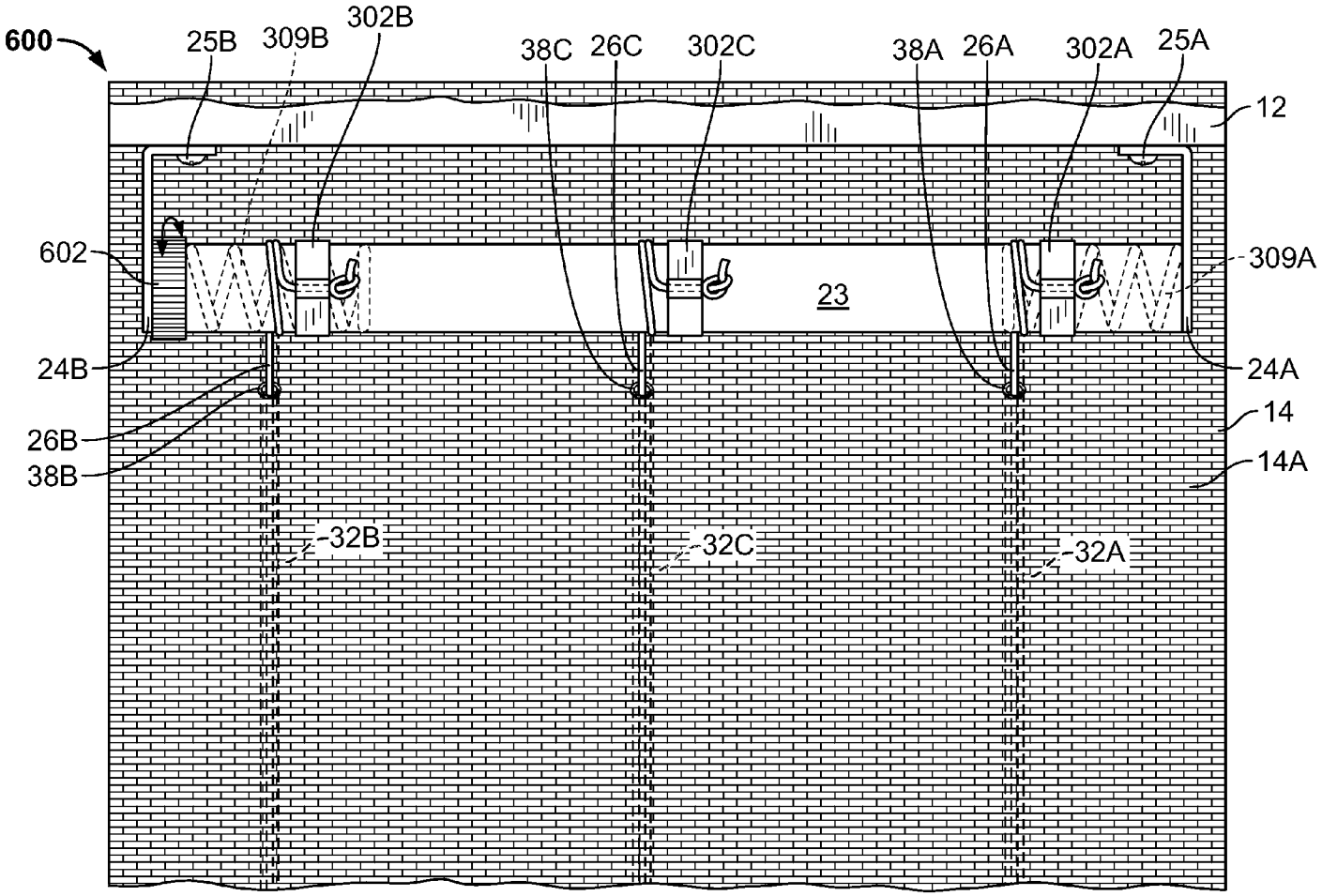
FIG. 32 is a fragmentary elevational view illustrating a further embodiment of the present invention.

FIG. 32 illustrates another embodiment comprising a shade 600. In this embodiment, the roller 23 is fitted with a ribbed wheel 602 at one end of the roller 23, adjacent the bracket 24. The ribbed wheel 602 is provided to enable a user to adjust the tension of the springs 309A, 309B in the roller 23 to accommodate material 14 that is of varying weights. Although shown in FIG. 32 with the roller 23 and springs 309A, 309B, the ribbed wheels 602 can be used with any of the aforementioned spring-loaded mechanisms used to lower and raise the shade. Furthermore, an additional ribbed wheel 602 may be used depending on the number of springs that may require adjustment.

Figure 33:
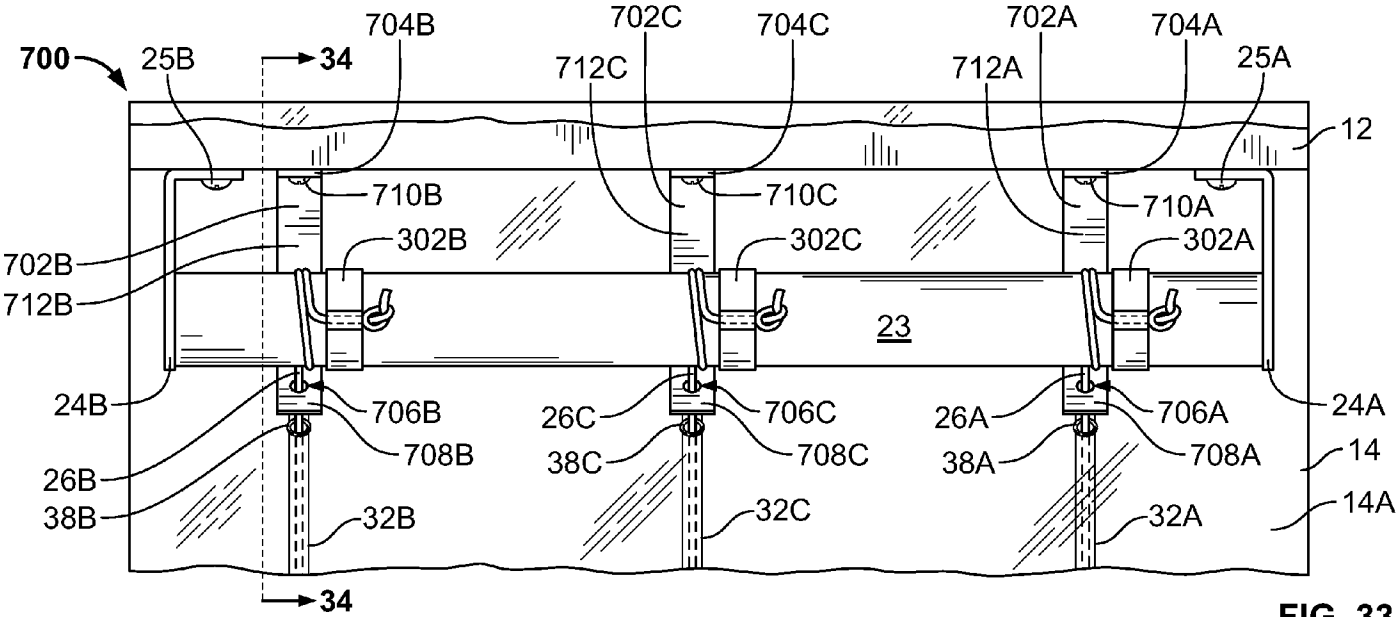
FIG. 33 is a fragmentary elevational view illustrating another embodiment of the present invention.
Figure 34:
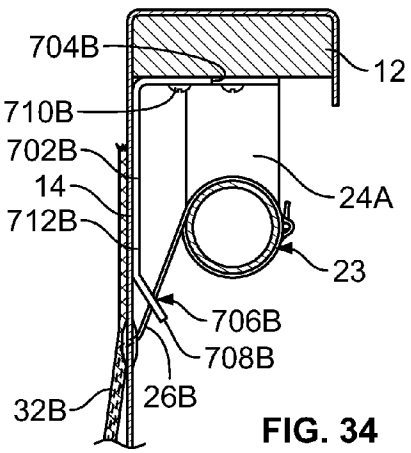
FIG. 34 is a sectional view taken generally along the lines 34-34 of FIG. 33.

FIGS. 33 and 34 illustrate another embodiment comprising a shade 700. In this embodiment, stop brackets 702A, 702B, 702C are fastened to the headrail 12 on top ends 704A, 704B, 704C, respectively, and include bores 706A, 706B, 706C on bottom ends 708A, 708B, 708C, respectively. The stop brackets 702A, 702B, 702C are made of any durable material such as metal or plastic and are attached to the headrail 12 by any suitable fasteners such as screws 710A, 710B, and 710C, respectively. As shown in FIG. 34, the stop brackets 702 have a general. "L" shape with bottom ends 708A, 70813, 708C being disposed at a slight angle with respect to a downwardly depending leg 712A, 712B, 712C of each stop bracket 702A, 702B, 702C, respectively. The downwardly depending legs 712 of each stop brackets 702 are disposed between top end 704 and bottom end 708, respectively, and are disposed substantially perpendicular to top ends 704. Alternatively, the stop brackets 702 may be of another suitable size and shape. Cords 26A, 26B, 26C are attached to the roller 23 with corresponding clips 302A, 302B, 302C (as shown in FIGS. 11-13) and are threaded through the bores 706A, 706B, 706C, respectively, into shrouds 32A, 32B, 32C, respectively. The stop brackets 702 are provided to prevent shade material that is light-weight or delicate from being rolled-up onto the roller 23. Specifically, as the cords 26 wind around the roller 23, the bottom ends 708 of the stop brackets 702 prevent the shade material 14 from being carried with the cords 26, thereby enabling the cords 26 to continue to move toward the roller unrestricted. Although three stop brackets 702A, 702B, 702C are shown in FIG. 33, any number of brackets may be used. Furthermore, the stop brackets may be used in conjunction with any of the embodiments disclosed herein.

Figure 35:
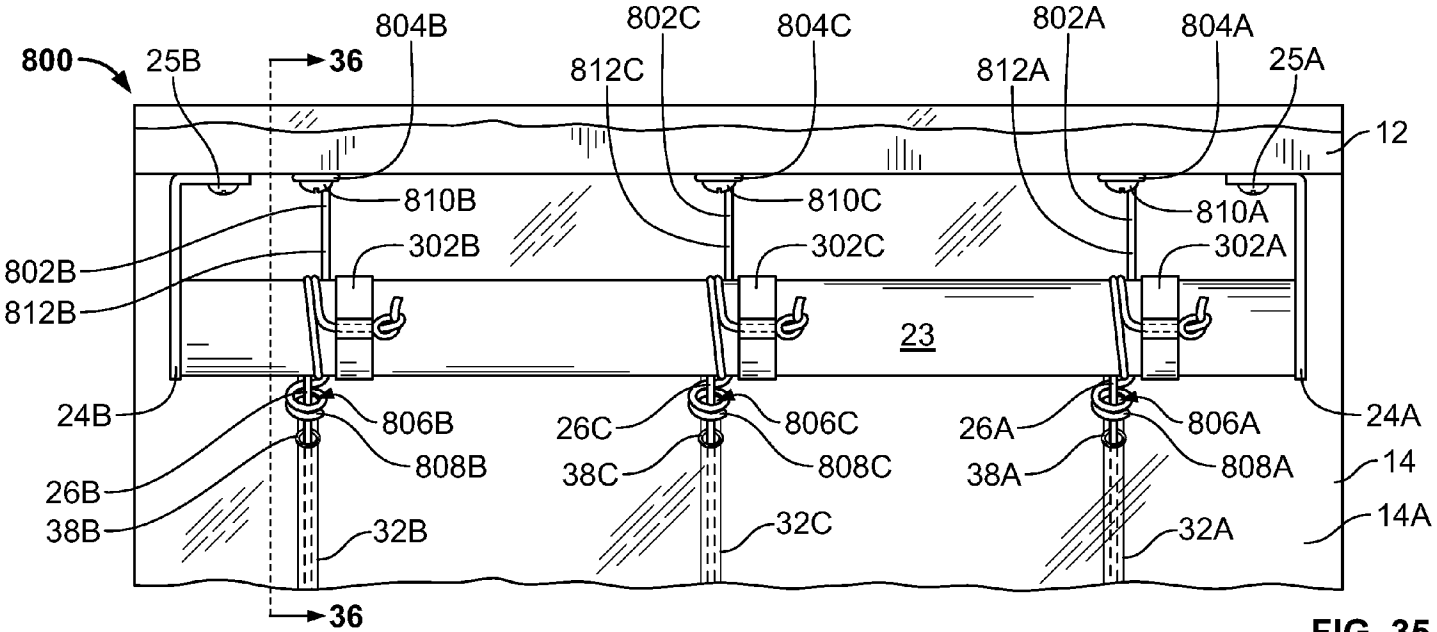
FIG. 35 is a fragmentary elevational view illustrating a further embodiment of the present invention.
Figure 36:
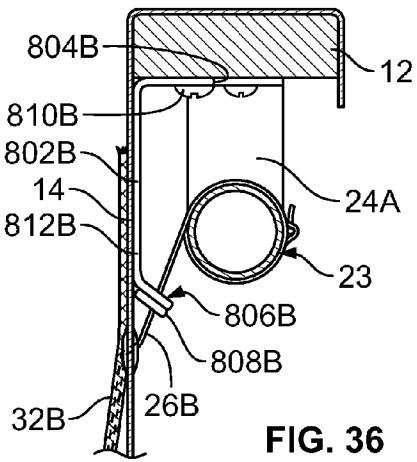
FIG. 36 is a sectional view taken generally along the lines 36-36 of FIG. 35.

FIGS. 35 and 36 illustrate an embodiment of a shade 800 including an alternate embodiment of the stop brackets discussed above. As before, the stop brackets are provided to prevent shade material that is light-weight or delicate from being rolled-up onto the roller 23. In this embodiment, the stop brackets 802A, 802B, 802C have top ends 804A, 804B, 804C and are made of a continuous piece of flexible metal or wire, which is bent or otherwise formed to create holes or bores 806A, 806B, 806C on bottom ends 808A, 808B, 808C, respectively. The stop brackets 802 are attached to the headrail 12 at top ends 804A, 804B, 804C by any suitable fasteners such as screws 810A, 810B, and 810C, respectively. As shown in FIG. 36, the stop brackets 802 have a general "L" shape with bottom ends 808 being disposed at a slight angle with respect to a downwardly depending leg 812A, 812B, 812C of each stop bracket 802A, 802B, 802C, respectively. The downwardly depending legs 812 of each stop brackets 802 are disposed between top end 804 and bottom end 808, respectively, and are disposed substantially perpendicular to top ends 804. Alternatively, the stop brackets 802 may be of another suitable size and shape. Cords 26A, 26B, 26C are attached to the roller 23 with corresponding clips 302A, 302B, 3020 (as shown in FIGS. 11-13) and are threaded through the bores 806A, 806B, 806C, respectively, into shrouds 32A, 32B, 32C, respectively.

To assemble and use the window shade 700/800, a user obtains a stop bracket 702/802. The top end 704/804 of the stop bracket 702/802 is attached to the headrail 12. Preferably, the top end 704/804 is positioned adjacent the headrail 12 so that the bottom end 708/808 of the stop bracket 702/802 is disposed between the roller 23 and the shade material 14. A fastener 710/810 is then inserted through the top end 704/804 into the headrail 12. The cord 26 may then be threaded through the bore 706/806 and pulled to raise the shade material 14.

Figure 37:
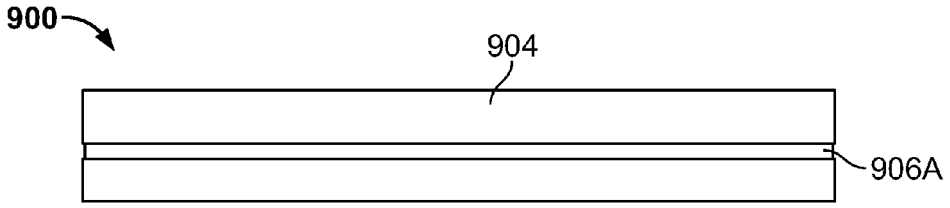
FIG. 37 is a front elevation view of another embodiment of a roller.
Figure 38:
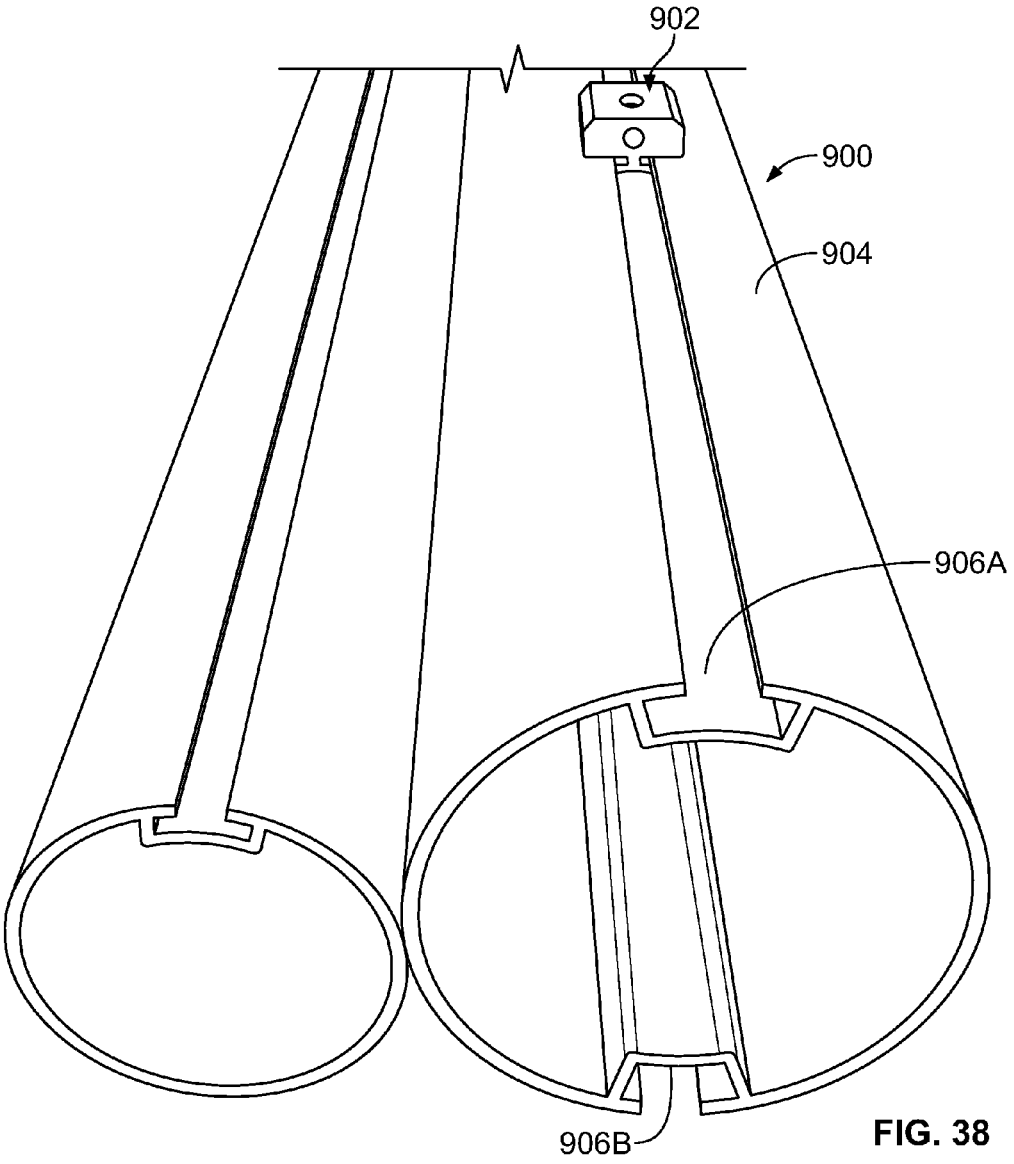
FIG. 38 is a perspective side view of the roller of FIG. 37 with varying diameters.

FIGS. 37-40 show another embodiment of a roller 900 and a cord attachment member 902 that can be used to secure one end of the cord 26 to the roller. The roller 900 and cord attachment member 902 can be used in place of the roller 23 and clips 302 in any one of the shade embodiments mentioned above. As shown in FIGS. 37-38, the roller 900 consists of a hollow tube 904, which can be made of any suitable material such as a strong, light-weight metal, e.g., aluminum, or plastic. The hollow tube 904 may have different diameters to accommodate shade materials of different lengths and weights and may be painted, tinted, coated, or dyed in different colors. Two channels 906A,B are disposed in the hollow tube 904 at locations diametrically opposite to each other. The channels 906A, B are defined by two walls that protrude into an interior of the hollow tube 904, and one or more cord attachment members 902 engage and are retained within such walls.

Figure 39:
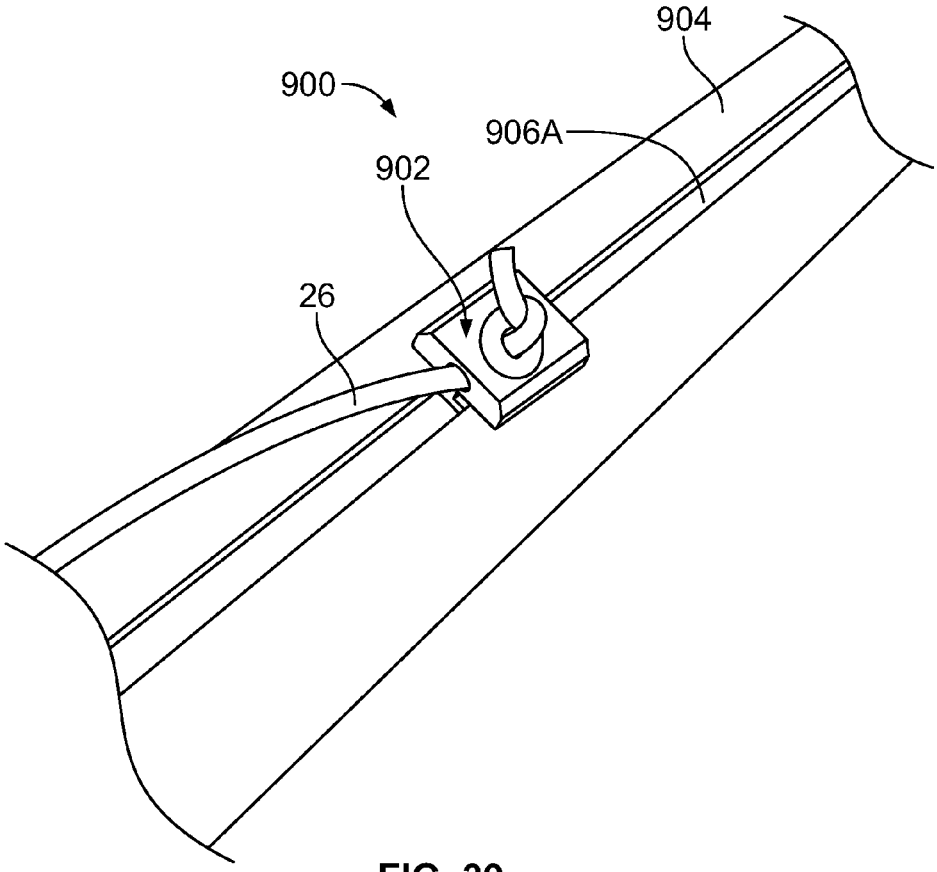
FIG. 39 is a fragmentary perspective view of the roller of FIG. 37 with a cord attachment mechanism and cord shown.
Figure 40:
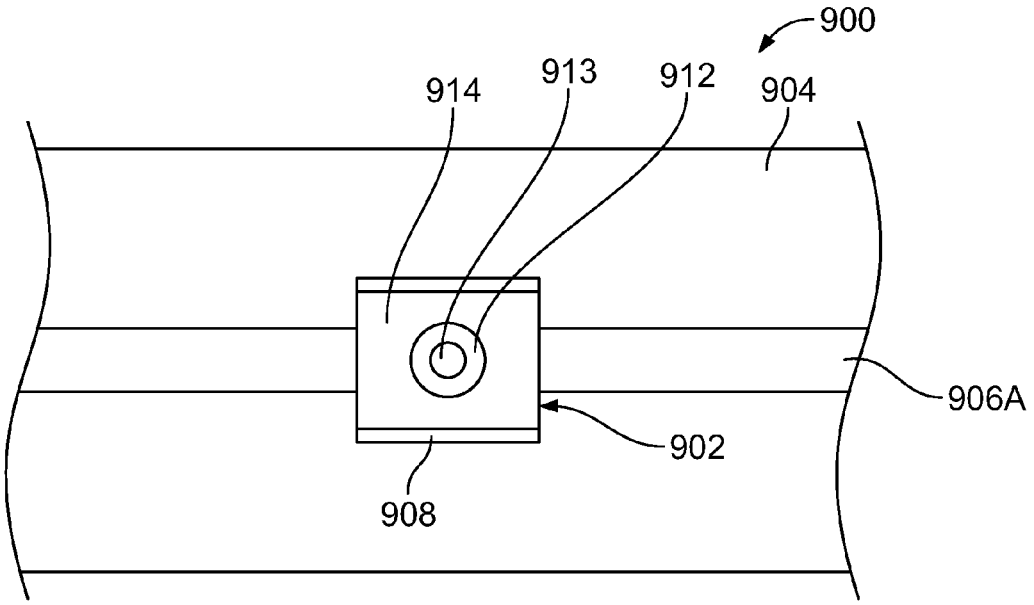
FIG. 40 is a fragmentary top plan view of the roller of FIG. 39 without a cord.

FIGS. 39 and 40 show the cord attachment member 902 attached to the hollow tube 904 via the channel 906A. FIG. 39 shows the cord attachment member 902 with a cord 26 attached and FIG. 40 shows the cord attachment member 902 without a cord 26 attached to the attachment member.

Figure 41:
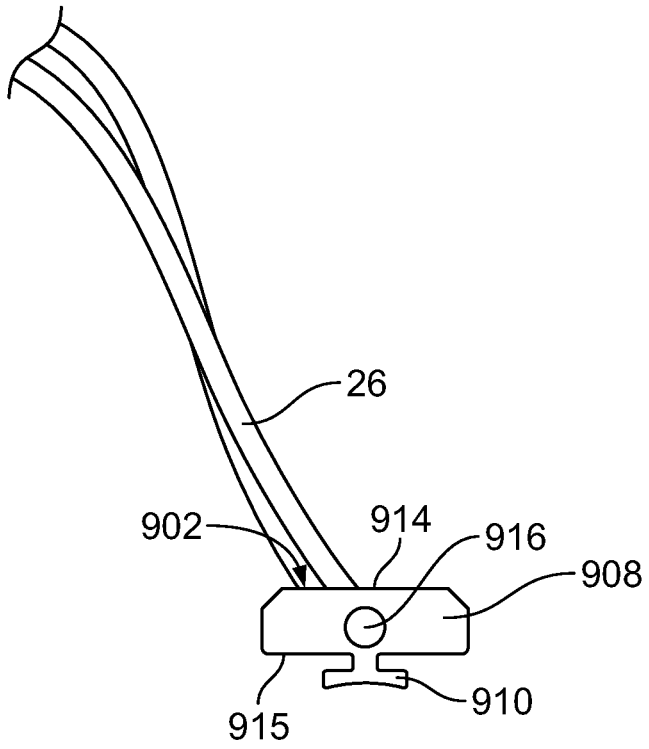
FIG. 41 is a side elevational view of the attachment mechanism of FIGS. 37 and 39.

FIG. 41 shows a side view of the attachment. The cord attachment member 902 has a first portion 908 and second portion 910. The first portion 908 may be of any shape that is suitable to rest atop the channel 906. Here the first portion 908 is shown to be substantially rectangular in shape.

The first portion 908 includes a first hole 912 located on a top 914 of the first portion 908. The cord hole 912 extends through the first portion 908 until it reaches a center potion. The first portion 908 also contains a threaded screw hole 913 (shown in FIG. 40), disposed directly below the cord hole 912. The screw hole 913 has a diameter shorter than that of the cord hole 912 and extends from the center portion of the first portion 908 through to a bottom potion 915 of the first potion 908.

As best shown in FIG. 41, a bore 916 is located on a side of the first portion 908. The bore 916 extends through the entire length of the first portion 908 and intersects the cord hole 912 and the screw hole 913 at the center portion of the first portion 908. The intersection of the cord hole 912 and bore 916 provide a channel through which the cord 26 can be passed. The cord first enters the bore 916 and then is passed through the cord hole 912. The diameter of the bore 916 is shorter than the diameter of the cord hole 912 so that when an end of the cord is tied into a knot after being passed through the cord hole 912, the knot can partially lie within the cod hole 912, but cannot pass through the bore 916.

The second portion 910 of the cord attachment member 902 may be shaped in any suitable manner to enable the cord attachment member 902 to movably engage the channel 906. As best shown in FIG. 41, the second portion 910 in this embodiment is shaped like an upside down "T" and has a slight curve on the horizontal cross member of the "T". The second portion 910 is attached to the hollow tube 904 by sliding the second portion 910 into the channel 906 on one end of the hollow tube 904. Once the attachment member 902 is slid into place, a set screw or other suitable fastener is inserted through the cord hole 912 and into threads in the screw hole 913. As the screw or other fastener is screwed into the threads, the second portion 910 is pushed against the upper walls of the channel 906 thereby forming a friction-fit connection, which prevents the attachment member 902 from moving about.

Figure 42:
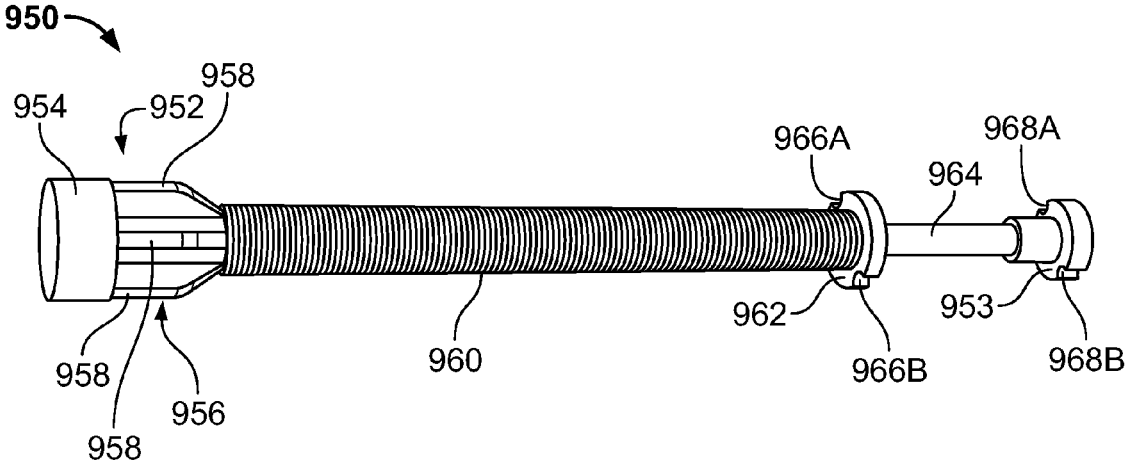
FIG. 42 is a perspective view of a spring-loaded mechanism.

FIG. 42 shows an embodiment of a spring-loaded mechanism 950, which can be inserted into the roller 23/900. The spring mechanism 950 is provided in various sizes and strengths to accommodate varying weights of the shade material. Furthermore, the spring-loaded mechanism 950 may be attached to side brackets 24 in the same or similar manner that discussed in relation to spring-loaded rotatable spindles 21.

The spring-loaded mechanism 950 has a first end portion 952 and a second end potion 953 opposite the first end potion. The first end portion 952 comprises a wheel 954 and a securing member 956. The wheel 954 has a diameter that is the same or larger than the diameter of the roller 23, 900, and the securing member 952 has a diameter that is slightly less than the diameter of the wheel and roller. Thus, when the spring-loaded mechanism 950 is placed within a roller 23/900 the wheel 952 abuts one end of the roller and the securing member 956 is covered by the roller. Furthermore, the securing member 956 has protrusions 958, which engage an interior side of the roller 23/900.

A torsion spring 960 is attached at one end to the securing member 956 of the spring-loaded mechanism 950 and at its other end to a drive collar 962, which is disposed between the first and second end potions 952, 953. A shaft 964 is attached to the first and second end potions 952, 953 and extends through the torsion spring 960 and drive collar 962. In addition, the drive collar 962 and the second end portion 953 have identical sets of grooves 966A,B and 968A,B, respectively. The set of grooves 966A,B and 968A, B are shaped to engage the walls of the channels 906A,B and enable the torsion spring, 960, drive collar 962, and second end portion 953 to rotate together relative to the first end portion 952 when the shade is pulled down. The second end portion 953 may also be an oil brake, which is a mechanism used to slow down the uncoiling of the torsion spring, so that the roller 23/900 does not rotate rapidly and lift up the shade material 14 too quickly, which may cause damage to the shade or injury to the user. Furthermore, the drive collar 962 and the second end portion 953 also have a diameter slightly less than the roller 23/900 to enable the spring-loaded mechanism 950 to be inserted into the roller 23/900.

INDUSTRIAL APPLICABILITY

The shades of the foregoing embodiments are not limited to the precise details disclosed herein, but may be modified to combine aspects of one embodiment with another embodiment. The shades disclosed herein may be assembled in an automated manner or by hand, or by a combination of both techniques.

Numerous further modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications that come within the scope of the appended claims are reserved.

I claim:

1. A window shade, comprising:

a headrail adapted for mounting adjacent a window;

a rotatably mounted roller;

a shading material having a first end attached to the headrail, a second end opposite the first end, and a face between the first and second ends;

a cord disposed adjacent the face and secured to the roller wherein rotation of the roller causes the cord to be wound about or unwound from the roller for moving the shading material between a stowed position in which the shading material is collected adjacent the headrail and a deployed position in which at least a portion of the shading material extends away from the headrail;

a stop bracket disposed adjacent the face having a first portion attached to the headrail and a second portion containing a bore, wherein the cord extends from the roller through the bore and is secured to the shading material;

a handle directly attached to an end of cord, wherein a portion of the cord proximate the end is secured to the shading material, and the handle is unsecured to the shading material and is pendant from the end of the cord;

including first, second, and third spaced cord guides secured to and extending outwardly from the face, wherein the first cord guide is disposed at a first location, the second cord guide is disposed at a second location farther away from the headrail than the first location, and the third cord guide is disposed at a third location farther away from the headrail than the first and second locations, wherein the cord is secured to the shading material at a fourth location farther away from the headrail than the third location and wherein each cord guide surrounds the cord; and a shroud defining an internal passage through which the cord extends, wherein the shroud is adapted to extend longitudinally as the shade portion is moved toward the deployed position and the shroud is adapted to collapse longitudinally as the shade portion is moved toward the stowed position wherein the shroud is unsecured to the shading material at all locations between adjacent cord guides.

2. The window shade of claim 1, wherein the handle is a tassel.

3. The window shade of claim 1, wherein the handle is disposed adjacent the face.

4. The window shade of claim 1, wherein the handle passes through a hole in the shading material and is disposed adjacent the hole on a side of the shading material opposite the face.

5. The window shade of claim 1, further including a spool carried by the roller and about which the cord is wound.

6. The window shade of claim 1, wherein the cord guides are adapted to create and be disposed at folds in the shading material when the shading material is in the stowed position.

7. The window shade of claim 1, wherein the cord is secured to the roller by a clip.

8. The window shade of claim 1, wherein the stop bracket is secured to the headrail by a screw that extends into the headrail.

9. The window shade of claim 1, wherein the shading material is light-weight and translucent.

10. The window shade of claim 1, wherein the roller comprises a spring.

11. The window shade of claim 10, further comprising a ribbed wheel attached to one side of the roller, whereby turning the ribbed wheel adjusts the tension in the spring.

12. The window shade of claim 1, wherein the roller and stop bracket are disposed on a side of the shading material opposite the face and the cord extends from the roller through the bore in the stop bracket and through an opening in the shading material at a location adjacent the roller.

13. The window shade of claim 12, wherein the handle is disposed adjacent the face.

14. The window shade of claim 12, wherein the handle passes through a hole in the shading material and is disposed adjacent the hole on a side of the shading material opposite the face.

15. The window shade of claim 12, wherein the opening comprises a grommet.

16. The window shade of claim 1, wherein the roller includes walls defining a channel.

17. The window shade of claim 16, further comprising a cord attachment member that engages the walls defining the channel.

18. The window shade of claim 17, wherein the cord attachment member has a first portion and second portion, the first portion having a hole and a bore through which the cord is passed and the second portion movably engaging the walls defining the channel.

19. The window shade of claim 1, wherein the shading material extends downwardly from the headrail and is folded back and attached to the face of the shading material, the face comprising a rear side of the shading material, at various points thereby creating a series of horizontal folds that form a continuous waterfall on a front side of the material and a series of hemmed edges on the rear side.

20. The window shade of claim 19, wherein the cord guides are attached to the hemmed edges.

21. The window shade of claim 19, wherein at least one strip is vertically attached at one end to an upper portion of the shading material and at an opposite end to a lower portion of the shading material.

22. The window shade of claim 21, wherein the at least one strip is attached to the hemmed edges at various points between the two opposing ends.

23. The window shade of claim 22, wherein the at least one strip is a flexible plastic.

24. A window shade, comprising:

a headrail adapted for mounting adjacent a window;

a shading material having an upper end attached to the headrail and a lower end opposite the upper end;

means for raising and lowering the shading material relative to the headrail to define, respectively, a stowed position in which the shading material is collapsed and collected beneath the headrail and a deployed position in which the shading material is at least partially extended away from the headrail;

first and second cords each of which is attached at a first end thereof to the means for raising and lowering and extends downwardly away from the headrail and is attached at a second end thereof to the lower end of the shading material;

first and second collapsible members each defining an internal passage extending in a longitudinal direction thereof, the first and second cords being disposed within a portion of the internal passages of the first and second collapsible members, respectively;

first and second stop brackets disposed adjacent the shading material each having a first portion attached to the headrail and a second portion containing a bore, wherein the first and second cords extend from the means for raising and lowering through the bores of the first and second stop brackets, respectively, and into the first and second collapsible members, respectively; and a handle secured to at least one of the first and second cords.

25. The window shade of claim 24, wherein the first and second collapsible members are adapted to extend longitudinally as the shading material is lowered toward the deployed position and the first and second collapsible members are adapted to collapse longitudinally as the shading material is raised toward the stowed position.

26. The window shade of claim 24, wherein the handle is adjacent a rear face of the shading material.

27. The window shade of claim 24, wherein the cord guides are adapted to create and be disposed at folds in the shading material when the shading material is in the stowed position.

28. The window shade of claim 24, wherein each collapsible member is a loosely woven material.

29. The window shade of claim 24, wherein the handle is secured to only one of the first and second cords.

30. The window shade of claim 29, wherein the handle is secured to the first cord and the first cord passes through a grommet in the shading material at a lower end thereof and the handle is adjacent a front face of the shading material.

31. The window shade of claim 24, wherein the raising and lowering means comprises a spring-loaded roller rotatably mounted adjacent the headrail.

32. The window shade of claim 31, wherein the first and second cords wind about the roller when the shading material is raised and the first and second cords unwind from the roller when the shading material is lowered and the spring-loaded roller can be selectably locked against rotation by a user to permit the user to position the shading material at a desired location.

33. The window shade of claim 31, wherein the roller is disposed adjacent a front face of the shading material and the first and second cords pass through first and second openings, respectively, in the shading material at locations adjacent the roller.

34. The window shade of claim 24, wherein the means for raising and lowering includes walls defining a channel.

35. The window shade of claim 34, further comprising a cord attachment member that engages the walls defining the channel.

36. The window shade of claim 35, wherein the cord attachment member has a first portion and second portion, the first portion having a hole and a bore through which one of the first and second cords is passed and the second portion movably engaging the walls defining the channel.

37. The window shade of claim 24, further comprising first and second sets of cord guides secured to the shading material, each set of the first and second sets of cord guides being substantially vertically aligned so that a lowermost cord guide thereof is in proximity to the lower end of the shading material and an uppermost cord guide thereof is in proximity to the headrail, the first cord passing through the first set of cord guides and being attached to the lowermost cord guide of the first set, the second cord passing through the second set of cord guides and being attached to the lowermost cord guide of the second set.

38. The window shade of claim 37, wherein each of the first and second collapsible members comprises a shroud attached to each cord guide of the first and second sets of cord guides, respectively.

39. The window shade of claim 37, wherein the first and second sets of cord guides are secured to a rear face of the shading material.

40. The window shade of claim 37, wherein each collapsible member is unsecured to the shading material at all locations between adjacent cord guides.

41. The window shade of claim 37, wherein the shading material extends downwardly from the headrail and is folded back and attached to a rear face of the shading material at various points thereby creating a series of horizontal folds that form a continuous waterfall on a front face of the material and a series of hemmed edges on the rear face.

42. The window shade of claim 41, wherein the cord guides are attached to the hemmed edges.

43. The window shade of claim 41, wherein at least one strip is vertically attached at one end to an upper portion of the shading material and at an opposite end to a lower portion of the shading material on the rear face.

44. The window shade of claim 43, wherein the at least one strip is attached to the hemmed edges at various points between the two opposing ends.

45. The window shade of claim 44, wherein the at least one strip is a flexible plastic.

* * * * *